US008517854B2

(12) United States Patent
Jung

(10) Patent No.: US 8,517,854 B2
(45) Date of Patent: Aug. 27, 2013

(54) AUTOMATIC GOLF SCORING SYSTEM THAT DETECTS SHOT BASED UPON MOTION OF GOLFER AND CADDY

(75) Inventor: JeYoung Jung, Seoul (KR)

(73) Assignee: Egtron, Co., Ltd., Seoul (KR)

( * ) Notice: Subject to any disclaimer, the term of this patent is extended or adjusted under 35 U.S.C. 154(b) by 154 days.

(21) Appl. No.: 13/127,935

(22) PCT Filed: Nov. 3, 2009

(86) PCT No.: PCT/KR2009/006418

§ 371 (c)(1),
(2), (4) Date: May 5, 2011

(87) PCT Pub. No.: WO2010/053283

PCT Pub. Date: May 14, 2010

(65) Prior Publication Data

US 2011/0213474 A1 Sep. 1, 2011

(30) Foreign Application Priority Data

Nov. 5, 2008 (KR) ..... 10-2008-0109322
Dec. 9, 2008 (KR) ..... 10-2008-0124706
Dec. 19, 2008 (KR) ..... 10-2008-0124709

(51) Int. Cl.
*A63B 57/00* (2006.01)

(52) U.S. Cl.
USPC ..... 473/283; 473/131; 473/223; 473/406; 473/407; 700/91; 700/92; 700/93

(58) Field of Classification Search
USPC ..... 473/131, 223, 283, 402, 403, 406, 473/407; 700/91–93
See application file for complete search history.

(56) References Cited

U.S. PATENT DOCUMENTS

| | | | | |
|---|---|---|---|---|
| 5,507,485 | A * | 4/1996 | Fisher | 473/407 |
| 5,810,680 | A * | 9/1998 | Lobb et al. | 473/407 |
| 6,030,109 | A * | 2/2000 | Lobsenz | 700/92 |
| 6,456,938 | B1 * | 9/2002 | Barnard | 701/454 |
| 7,175,177 | B2 * | 2/2007 | Meifu et al. | 473/407 |
| 2002/0151994 | A1 * | 10/2002 | Sisco | 700/91 |
| 2005/0026709 | A1 * | 2/2005 | Palmer et al. | 473/131 |
| 2007/0129178 | A1 * | 6/2007 | Reeves | 473/407 |
| 2009/0017944 | A1 * | 1/2009 | Savarese et al. | 473/407 |
| 2009/0111602 | A1 * | 4/2009 | Savarese et al. | 473/283 |
| 2009/0209358 | A1 * | 8/2009 | Niegowski | 473/223 |

* cited by examiner

*Primary Examiner* — Lawrence Galka
(74) *Attorney, Agent, or Firm* — Invent Capture, LLC.; Samuel S. Cho

(57) ABSTRACT

Disclosed is a real-time, automatic golf scoring apparatus that can automatically tally golf scores and record the positions of golf shots. The real-time, automatic golf scoring apparatus includes: a storage unit for storing information regarding driver shot positions at holes; a communications unit for receiving position computation information for calculating a current position of a golfer; and a control unit for counting the number of driver shots if a condition on the number of driver shots based on the information regarding the driver shot positions and information regarding the current position of the golfer is satisfied using these means, the system is capable of providing useful real-time information to golf players and of automatically managing play records.

8 Claims, 24 Drawing Sheets

AUTOMATIC GOLF SCORING SYSTEM THAT DETECTS SHOT BASED UPON MOTION OF GOLFER AND CADDY

TECHNICAL FIELD

The present invention relates to an intelligent real-time golf tournament management system and a terminal used therein.

BACKGROUND OF INVENTION

As golf tournaments increasingly become popular owing to an economic growth, golf resorts have gradually introduced systems for managing golf tournaments owing to a development of information and technology (IT).

Although conventional introduced or published golf tournament systems provide golfers with particulars of golf tournaments, most of these systems manually input and provide golf tournament records.

Such manual input operations are very cumbersome and thus are scarcely introduced in golf resorts. Thus, golf resorts need a system that easily manages a golf tournament record in real time, provides golfers with useful information during tournaments, and manages golf tournaments in real time.

DETAILED DESCRIPTION OF THE INVENTION

Technical Problem

The present invention provides a golf score real-time automatic counting apparatus for automatically calculating and managing the number of shots and a trace of a golfer.

The present invention also provides a golf score real-time automatic counting apparatus for providing a golfer with information useful to a golf tournament that is being currently played without interfering with the golf tournament.

The present invention also provides a golf score real-time automatic counting apparatus used in a golf tournament management system that facilitates a golf tournament by using the number of shots and a trace of a golfer that are automatically computed.

The present invention also provides a putting shot real-time automatic counting apparatus that automatically manages a putting shot of a golfer in real time.

The present invention also provides a golf relay broadcasting system by which a view can view a golf tournament with interest by using the number of shots and a trace of a golfer that are automatically computed.

The present invention also provides an intelligent golf shot position real-time tracking system that automatically determines and manages a shot position of a golfer in real-time.

The present invention also provides an intelligent golf shot position real-time tracking system for providing a golfer with information useful to a golf tournament that is being currently played without interfering with the golf tournament.

The present invention also provides a golf tournament management system for automatically calculating and managing the number of shots and a trace of a golfer.

The present invention also provides a golf tournament management system for providing a golfer with information useful to a golf tournament that is being currently played without interfering with the golf tournament.

The present invention also provides a golf tournament management system that facilitates a golf tournament by using the number of shots and a trace of a golfer that are automatically computed in real time.

The present invention also provides a golf tournament management system that facilitates a golf tournament by using a putting shot and a putting position that are automatically computed in real time.

The present invention also automatically displays a score of a golfer in real time, easily records and manages the score of the golfer since the score of the golfer can be corrected as occasions demand, and provides the golfer with useful information without interfering with a golf tournament of the golfer.

Technical Solution

According to an aspect of an exemplary embodiment, there is provided a golf score real-time automatic counting apparatus including: a storage unit for storing information regarding driver shot positions at holes; a communications unit for receiving position computation information for calculating a current position of a golfer; and a control unit for counting the number of driver shots if a condition on the number of driver shots based on the information regarding the driver shot positions and information regarding the current position of the golfer is satisfied.

The control unit may determine that the condition on the number of driver shots is satisfied, if the golfer enters into the driver shot positions and leaves the driver shot positions after a predetermined period of time.

The control unit may determine that the condition on the number of driver shots is satisfied, if the golfer enters into the driver shot positions, leaves the driver shot positions after the predetermined period of time, and a driver shot estimated motion or driver shot estimated sound occurs by which the golfer is estimated to hit a driver shot.

The storage unit may further store information regarding fairway positions in fairway regions of the holes, wherein the control unit counts fairway shots by accumulating one par if a condition on the number of fairway shots is satisfied based on the information regarding fairway positions and the information regarding the current position of the golfer.

The control unit may determine that the condition on the number of fairway shots is satisfied, if the golfer is located in the fairway region, stays at a region of the fairway region for a predetermined period of time, and leaves the region.

The control unit may determine that the condition on the number of fairway shots is satisfied, if the golfer is located in the fairway region, stays at a region of the fairway region for a predetermined period of time, leaves the region, and a fairway shot estimated motion or fairway shot estimated sound occurs by which the golfer is estimated to hit a fairway shot.

The fairway shot estimated motion may be a motion of a golfers' waist.

The storage unit may further store information regarding green region positions in green regions of the holes, wherein the control unit counts putting shots by accumulation if a condition on the number of putting shots is satisfied based on the information regarding green region positions and the information regarding the current position of the golfer.

The condition on the number of putting shots may be determined to be satisfied if the golfer has no motion in a region of the green region for a predetermined period of time.

The control unit may select positions where the golfer does not move in the green region for the predetermined period of time, determine if there is a position where a putting shot estimated motion or putting shot estimated sound occurs, and, if the position where the putting shot estimated motion or the putting shot estimated sound occurs corresponds to one of the positions where the golfer does not move, determine that the condition on the number of putting shots is satisfied.

The control unit may select the positions where the golfer does not move in the green region for the predetermined period of time, select positions where a golf assistant does not move in the green region for the predetermined period of time, determine if there is the position where the putting shot estimated motion or the putting shot estimated sound occurs, and, if the position where the putting shot estimated motion or the putting shot estimated sound occurs corresponds to one of the positions where the golfer does not move and simultaneously corresponds to one of the positions where the golf assistant does not move, determine that the condition on the number of putting shots is satisfied.

The control unit may select the positions where the golfer does not move in the green region for the predetermined period of time, select the positions where the golf assistant does not move in the green region for the predetermined period of time, determine if there is a motion assisting in a putting shot of the golf assistant, and, if a position of the motion assisting in the putting shot of the golf assistant corresponds to one of the positions where the golfer does not move and simultaneously corresponds to one of the positions where the golf assistant does not move, determine that the condition on the number of putting shots is satisfied.

According to another aspect of an exemplary embodiment, there is provided an intelligent real-time golf tournament management system including a golfer terminal for being carried by a golfer and providing position computation information used to compute a position of the golfer; and a management server for receiving the position computation information from the golfer terminal and automatically calculating and storing a par of the golfer in real time based on the position computation information.

Meanwhile, the golfer terminal may provide a remaining distance from a current position of the golfer to a cup that is calculated based on the position computation information.

The remaining distance may be calculated by comparing the current position of the golfer and a previously stored position of the cup.

Meanwhile, the remaining distance may be calculated by the golfer terminal.

The remaining distance may be calculated by the management server and the calculated remaining distance may be transmitted to the golfer terminal.

Meanwhile, the management server may determine the par based on the position computation information of the golfer and previously stored hole information.

The previously stored hole information may include position information regarding a driver shot region, position information regarding a fairway region, and position information regarding a green region.

Meanwhile, the management server may count driver shots if a driver shot counting condition is satisfied and register a position satisfying the driver shot counting condition as a driver shot position.

The management server may determine that the driver shot counting condition is satisfied if at least one of a driver shot estimated motion by which the golfer is estimated to hit a shot and driver shot estimated sound by which the golfer is estimated to hit the shot exists in the driver shot region.

Meanwhile, the management server may count fairway shots if a fairway shot counting condition is satisfied and register a position satisfying the fairway shot counting condition as a fairway shot position.

The management server may determine that the fairway shot counting condition is satisfied if at least one of a fairway shot estimated motion by which the golfer is estimated to hit a shot and fairway shot estimated sound by which the golfer is estimated to hit the shot exists in the fairway shot region.

The management server may determine that the fairway shot counting condition is satisfied if the fairway shot estimated motion by which the golfer is estimated to hit the shot occurs in the fairway shot region, the fairway shot estimated sound by which the golfer is estimated to hit the shot occurs in the fairway shot region, and the golfer stays at a region of the fairway shot region for a predetermined period of time.

The management server may count putting shots if a green region shot counting condition is satisfied and register a position satisfying the green region shot counting condition as a putting shot position.

The management server may determine that the green region shot counting condition is satisfied if one of a putting shot estimated motion by which the golfer is estimated to hit the shot, putting shot estimated sound by which the golfer is estimated to hit the shot, a putting shot estimated motion of a golf assistant, and a case where the golfer stays at a region of the green region for a predetermined period of time occurs.

The intelligent real-time golf tournament management system may further include a second terminal for receiving and displaying the par calculated by the management server.

According to another aspect of an exemplary embodiment, there is provided an intelligent golf shot position real-time tracking system including: a storage unit for to storing information regarding driver shot positions at holes; a communications unit for receiving position computation information for calculating a current position of a golfer; and a control unit for registering the current position of the golfer as a driver shot position if a driver shot position registration condition based on the information regarding the driver shot positions and information regarding the current position of the golfer is satisfied.

The control unit may determine that the driver shot position registration condition is satisfied, if the golfer enters into the driver shot positions and leaves the driver shot positions after a predetermined period of time.

Meanwhile, the control unit may determine that the driver shot position registration condition is satisfied, if the golfer enters into the driver shot positions, leaves the driver shot positions after the predetermined period of time, and a driver shot estimated motion or driver shot estimated sound occurs by which the golfer is estimated to hit a driver shot.

The storage unit may further store information regarding fairway positions in fairway regions of the holes, wherein the control unit may register a position of the golfer satisfying a fairway shot position registration condition as a fairway shot position if the fairway shot position registration condition based on the information regarding fairway positions and the position computation information of the golfer is satisfied.

Meanwhile, the control unit may determine that the fairway shot position registration condition is satisfied, if the golfer is located in the fairway region, stays at a region of the fairway region for a predetermined period of time, and leaves the region.

The control unit may determine that the fairway shot position registration condition is satisfied, if the golfer is located in the fairway region, stays at a region of the fairway region for a predetermined period of time, leaves the region, and a fairway shot estimated motion or fairway shot estimated sound occurs by which the golfer is estimated to hit a fairway shot.

The fairway shot estimated motion may be a motion of a golfers' waist.

The storage unit may further store information regarding green region positions in green regions of the holes, wherein the control unit may register a position of the golfer satisfying a putting shot position registration condition as a putting shot position if the putting shot position registration condition based on the information regarding green region positions and the position computation information of the golfer is satisfied.

The control unit may determine that the putting shot position registration condition is satisfied if the golfer has no motion in a region of the green region for a predetermined period of time.

Meanwhile, the control unit may select positions where the golfer does not move in the green region for the predetermined period of time, determine if there is a position where a putting shot estimated motion or putting shot estimated sound occurs, and, if the position where the putting shot estimated motion or the putting shot estimated sound occurs corresponds to one of the positions where the golfer does not move, determine that the putting shot position registration condition is satisfied.

The control unit may select the positions where the golfer does not move in the green region for the predetermined period of time, select positions where a golf assistant does not move in the green region for the predetermined period of time, determine if there is the position where the putting shot estimated motion or the putting shot estimated sound occurs, and, if the position where the putting shot estimated motion or the putting shot estimated sound occurs corresponds to one of the positions where the golfer does not move and simultaneously corresponds to one of the positions where the golf assistant does not move, determine that the putting shot position registration condition is satisfied.

Meanwhile, the control unit may select the positions where the golfer does not move in the green region for the predetermined period of time, select the positions where the golf assistant does not move in the green region for the predetermined period of time, determine if there is a motion assisting in a putting shot of the golf assistant, and, if a position of the motion assisting in the putting shot of the golf assistant corresponds to one of the positions where the golfer does not move and simultaneously corresponds to one of the positions where the golf assistant does not move, determine that the putting shot position registration condition is satisfied.

According to another aspect of an exemplary embodiment, there is provided a distance display apparatus for a golfer including a position computation information providing unit for obtaining information used to compute a current position of the golfer; and a display unit for displaying a remaining distance from the current position of the golfer and a cup based on the position computation information obtained by the position computation information providing unit.

The remaining distance may be calculated by comparing the current position of the golfer computed from the position computation information and previously stored position information of the cup.

The distance display apparatus for the golfer may further include a control unit for calculating the remaining distance by comparing the current position of the golfer computed from the position computation information and the previously stored position information of the cup, wherein the display unit may display the remaining distance calculated by the control unit.

The distance display apparatus for the golfer may further include a communication unit for receiving the remaining distance, from the outside, calculated by comparing the current position of the golfer computed from the position computation information and the previously stored position information of the cup, wherein the display unit may display the remaining distance received by the communication unit.

The distance display apparatus for the golfer may further include a motion detecting unit for detecting a motion of the golfer.

The motion detecting unit may detect at least one of a motion of the golfer who swings a waist and a motion of the golfer who sits and stands up.

The position computation information providing unit may be a global navigation satellite system (GNSS) receiver.

The remaining distance may be calculated by correcting the position of the golfer computed from the position computation information according to previously stored correction data and comparing the corrected position of the golfer and the previously stored position information of the cup.

The distance display apparatus for the golfer may further include a control unit for calculating the remaining distance by correcting the position of the golfer computed from the position computation information according to previously stored correction data and comparing the corrected position of the golfer and the previously stored position information of the cup, wherein the display unit may display the remaining distance calculated by the control unit.

The distance display apparatus for the golfer may further include a communication unit for receiving an accumulation par of the golfer at a corresponding hole in real time, wherein the display unit may display the accumulation par received by the communication unit in real time.

The distance display apparatus for the golfer may further include a communication unit for receiving the total accumulation par of the golfer by a current hole in real time, wherein the display unit may display the total accumulation par received by the communication unit in real time.

The distance display apparatus for the golfer may further include a communication unit for receiving the total accumulation par of the golfer by a hole right before a current hole and an accumulation par at the current hole in real time, wherein the display unit may display the total accumulation par and the accumulation par at the current hole received by the communication unit in real time.

The communication unit may transmit the position of the golfer computed by the position computation information providing unit to the outside, and the accumulation par of the golfer at the current hole received by the communication unit may be calculated based on the position of the golfer transmitted to the outside.

Meanwhile, the communication unit may transmit the position of the golfer computed by the position computation information providing unit to the outside, and the total accumulation par of the golfer by the current hole received by the communication unit may be calculated based on the position of the golfer transmitted to the outside.

According to another aspect of an exemplary embodiment, there is provided a golf score real-time automatic display apparatus including a communication unit for receiving golf shot information for golfers in real time during a golf tournament; a display unit for displaying the golf shot information for golfers received by the communication unit in real time; and an input unit for receiving a command to correct the display golf shot information from the outside.

The golf score real-time automatic display apparatus may further include a control unit for correcting the golf shot information received by the communication unit and displaying the corrected golf shot information in real time based on the command to correct the display golf shot information.

Meanwhile, the golf shot information received by the communication unit may be automatically computed golf shot information.

The input unit may include an increase unit for increasing golf shots included in the golf shot information displayed on the display unit and a reduction unit for reducing the golf shots included in the golf shot information displayed on the display unit.

Meanwhile, the put unit may include an increase unit for receiving a command to increase golf shots included in the golf shot information displayed on the display unit, a reduction unit for receiving a command to reduce the golf shots included in the golf shot information displayed on the display unit, and an acknowledgement unit for receiving a command to acknowledge that the golf shots included in the golf shot information displayed on the display unit are correct.

According to another aspect of an exemplary embodiment, there is provided a putting shot real-time automatic counting apparatus including a storage unit for storing position information regarding a plurality of base regions previously partitioned in a green region and first default putting numbers allocated to the plurality of base regions; and a control unit for receiving position computation information of a golfer in real time, determining a first putting position of the golfer based on the received position computation information, determining one of the plurality of base regions where the first putting position is positioned, and automatically calculating the putting number of the golfer based on the first default putting numbers allocated to the determined base region.

The control unit may determine the first default putting numbers allocated to the determined base region as the total putting number.

The control unit may determine second putting expectation regions based on the determined base region and the first putting position, determine one of the second putting expectation regions where the second putting position is positioned, and determine a second default putting number previously allocated to the second putting expectation region where the second putting position is positioned as the total putting number.

Meanwhile, the control unit may determine a first non-movement position of the golfer that does not move for a period of time previously determined by the golfer as the first putting position.

The control unit may select first non-movement positions of the golfer that does not move for the period of time previously determined by the golfer, select positions of putting shot estimated motions of the golfer as first putting shot estimated motion positions by using a motion detection result of the golfer, and determine a position corresponding to both the first non-movement positions and the first putting shot estimated motion positions as the first putting position.

Meanwhile, the control unit may select first non-movement positions of the golfer that does not move for the period of time previously determined by the golfer, select first non-movement positions of a golf assistant that does not move for the period of time previously determined by the golfer, and select positions of putting shot assistance estimated motions of the golf assistant as first putting shot assistance estimated motion positions by using a motion detection result of the golf assistant, and determine a position corresponding to all of the first non-movement positions of the golfer, the first non-movement positions of the golf assistant, and the first putting shot estimated motion positions as the first putting position.

Meanwhile, the plurality of base regions are partitioned as a first region, a second region, and a third region, wherein three pars are allocated to the first region, two pars are allocated to the second region, and one par is allocated to the third region.

The control unit may set a virtual straight line between the first putting position and a cup, set a plurality of virtual regions with respect to the set virtual straight line, and determine the second putting expectation regions from the plurality of virtual regions.

Meanwhile, if corrected data for the automatically calculated puffing number is input, the control unit may correct the putting number by reflecting the corrected data.

The corrected data may be transmitted through a terminal.

Meanwhile, the terminal may be at least one of a golf assistant terminal, a golfer terminal, and a terminal installed in transportation means for transporting the golfer.

Advantageous Effects

As described above, the present invention can automatically compute and manage the number of shots and a trace of a golfer in real time, thereby facilitating a golf tournament and providing the golfer with useful information without interfering with a tournament of the golfer. Furthermore, the present invention operates with a golf relay broadcasting system, and thus a viewer can view the golf tournament with interest.

MODE OF THE INVENTION

Hereinafter, the present invention will be described more fully with reference to the accompanying drawings, in which exemplary embodiments of the invention are shown.

Figure 1:
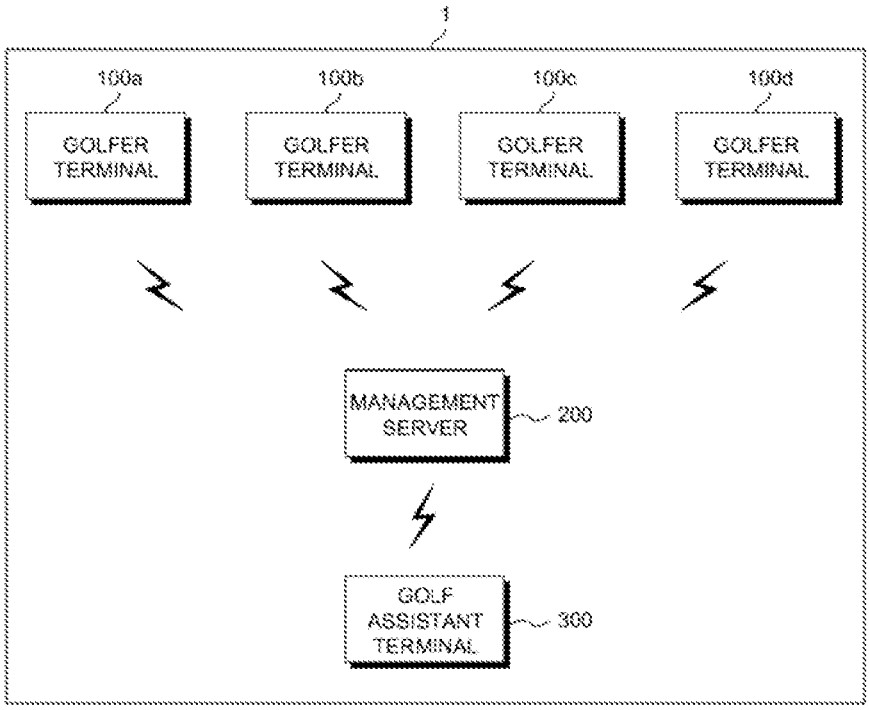
FIG. 1 is a block diagram of an intelligent real-time golf tournament management system according to an exemplary embodiment of the present invention.

FIG. 1 is a block diagram of an intelligent real-time golf tournament management system according to an exemplary embodiment of the present invention.

Referring to FIG. 1, the intelligent real-time golf tournament management system includes golfer terminals 100*a*, 100*b*, 100*c*, and 100*d*, a management server 200, and a golf assistant terminal 300.

Although the four golfer terminals are shown in FIG. 1, this is exemplary, and 1, 2, 3, or 4 or more golfer terminals may be included in the intelligent real-time golf tournament management system. Hereinafter, the golfer terminal 100*a* will now be described, and the other golfer terminals 100*b*, 100*c*, and 100*d* have similar or identical functions to that of the golfer terminal 100*a*, and thus detailed description thereof will be omitted.

The golfer terminal 100*a* is carried by a golfer, and includes position computation information used to compute a position thereof. In this regard, the "position computation information" may be information (for example, position information received from a global navigation satellite system (GNSS)) directly indicating the position or information (for example, an identifier ID inherently allocated to the golfer terminal 100*a* in an RFID system or a Wi-Fi system) used to compute the position.

The golfer terminal 100*a* may provide a remaining distance (hereinafter referred to as the "remaining distance") from a current position of a golfer to a cup CUP in real time. In this regard, the "cup" is located on a green region as a final target in which a golf ball goes, and the "remaining distance" is computed based on the position computation information owned by the golfer.

The management server 200 may receive the position computation information from the golfer terminal 100*a* and automatically compute and store a par (used as the same meaning as a golf shot or a golf score) of the golfer in real time based on the position computation information. In the present specification, the management server 200 is called as a "golf score real-time automatic counting apparatus".

The golf assistant terminal 300 displays the par of the golfer computed by the management server 200 in real time.

The "remaining distance" provided by the golfer terminal 100*a* may be calculated by the golfer terminal 100*a* or the management system 200.

According to an embodiment of the present invention, the golfer terminal 100*a* may directly calculate the "remaining distance" based on the position computation information" thereof.

According to another embodiment of the present invention, the management server 200 calculates the "remaining distance" based on the position computation information received from the golfer terminal 100 and transmits the calculated "remaining to distance" to the golfer terminal 100*a*. In this regard, the golfer terminal 100*a* displays the received "remaining distance" to the golfer.

The "remaining distance" may be calculated by comparing the current position of the golfer and a previously stored position of the cup. In the present specification, since the golfer carries the golfer terminal 100*a*, it is assumed that a current position of the golfer terminal 100*a* is the same as the current position of the golfer.

In an embodiment where the golfer terminal 100*a* calculates the "remaining distance", the golfer terminal 100*a* may calculate the "remaining distance" by previously storing information regarding a position of the cup and comparing the previously stored information on the position of the cup and information on the position of the golfer terminal 100*a*. In this regard, the information on the position of the golfer terminal 100*a* may be directly obtained from the GNSS or may be provided from the management server 200.

In an embodiment where the management server 200 calculates the "remaining distance", the management server 200 previously stores information regarding the position of the cup and may calculate the "remaining distance" by using the previously stored information on the position of the cup and the position computation information transmitted from the golfer terminal 100*a*. In this regard, to calculate the "remaining distance" more accurately, the management server 200 may calculate the "remaining distance" by correcting a position obtained from the position computation information transmitted from the golfer terminal 100*a* by using previously stored "correction data" and using the corrected position. The golfer terminal 100*a* may also calculate the "remaining distance" more accurately by using the previously stored correction data in the same manner.

The management server 200 calculates the par of the golfer based on the position computation information transmitted from the golfer terminal 100*a* and previously stored hole information. In this regard, the previously stored hole information includes position information regarding a driver shot region, position information regarding a fairway region, and position information regarding a green region. The position information may be, for example, a "position coordinate".

Figure 2:
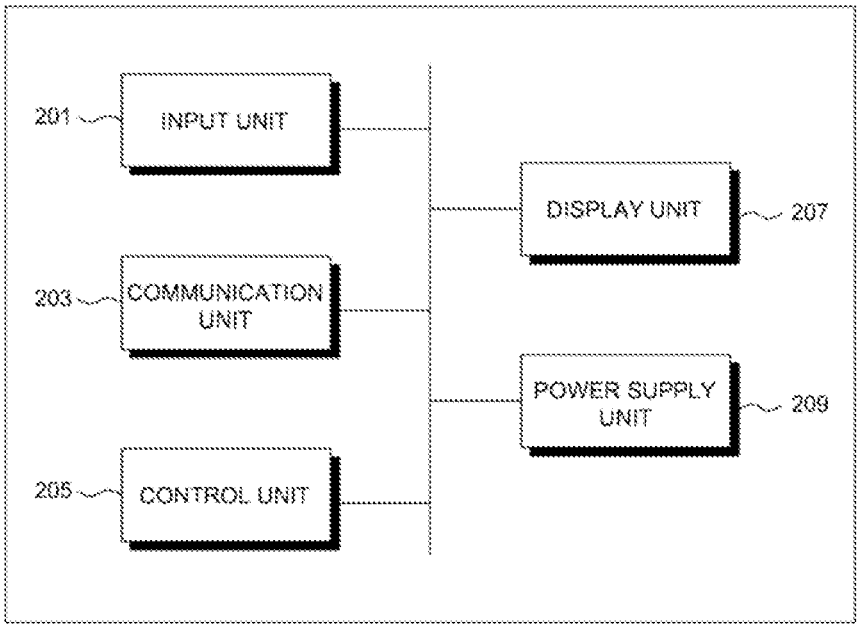
FIG. 2 is a block diagram of a golf assistant terminal according to an exemplary embodiment of the present invention.
Figure 4:
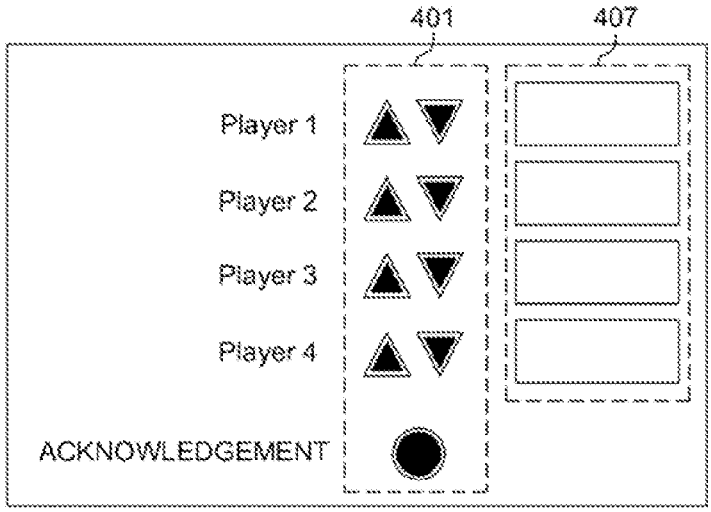
FIG. 4 is a diagram of a user interface unit of a golf assistant terminal according to an exemplary embodiment of the present invention.

FIG. 2 is a block diagram of the golf assistant terminal 300 according to an exemplary embodiment of the present invention. FIG. 4 is a diagram of a user interface unit of the golf assistant terminal 300 according to an exemplary embodiment of the present invention.

The golf assistant terminal 300 receives golf shot information of a golfer computed from the management server 200 in real time and automatically displays the golf shot information. The golf assistant terminal 300 may classify the golf shot information for each golfer and display the classified golf shot information.

The golf assistant terminal 300 according to an embodiment of the present invention may display the total accumulation par by a previous hole and an accumulation par of a current hole, and additionally include a means for automatically correcting the golf shot information.

In the present specification, the golf shot information includes i) the total accumulation par by the previous hole and ii) the accumulation par of the current hole, and may be used as indicating i) or ii), or i) and ii) according to embodiments.

Referring to FIG. 2, the golf assistant terminal 300 includes an input unit 201, a communication unit 203, a control unit 205, a display unit 207, and a power supply unit 209.

The input unit 201 is a means for inputting a command from outside, and specifically has a function of inputting the command for correcting a golf shot displayed on the display unit 207.

The communication unit 203 may receive the golf shot information for each golfer in real time.

The display unit 207 displays the golf shot information for each golfer received from the communication unit 203 in real time.

The power supply unit 209 supplies power necessary for operating the golf assistant terminal 300. For example, the power supply unit 209 may be a portable battery or a charging unit for charging power from outside. Alternatively, the power supply unit 209 may be a connection unit for directly supplying power from outside (through wireless or wired).

The control unit 205 may control a general operation of the golf assistant terminal 300. That is, the control unit 205 may control the display unit 207 to display the golf shot information received by the communication unit 203 or may operate according to the command input through the input unit 201. For example, if the input unit 203 inputs a correction command, the control unit 205 corrects the golf shot information corrected according to the correction command through the display unit 207.

The control unit 205 according to an embodiment of the present invention may perform a sound data processing function and/or an image data processing function so that the golf shot information can be displayed on the display unit 207. Meanwhile, the sound data processing function or the image data processing function is implemented by a separate constituent other than the control unit 205 within the scope of the present invention. Furthermore, a plurality of functions of the control unit 205 may be also implemented separately or in combination thereof within the scope of the present invention.

The control unit 205 transmits the corrected golf shot information to the management server 200 through the communication unit 203.

The input unit 201 according to an embodiment of the present invention may include a button that increases or reduces the golf shot information displayed on the display unit 207. The input unit 201 may include a button that acknowledges that the golf shot information displayed on the display unit 207 is correct. If the acknowledgement button is pressed, the control unit 207 may transmit an acknowledgement signal to the management server 200 through the communication unit 203.

The golf assistant terminal 300 according to an embodiment of the present invention additionally includes a motion detecting unit (not shown) that detects a motion of a golf assistant who carries the golf assistant terminal 300. The motion detecting unit (not shown) may detect the motion of the golf assistant in real time, for example, an up and down motion like the golf assistant sitting down and standing. A detection result obtained by the motion detecting unit (not shown) is transmitted to the management server 200 through the communicating unit 203.

In the present specification, the up and down motion means a sitting motion, a sitting and standing motion, etc. of the golf assistant or the golfer.

The golf assistant terminal 300 according to another embodiment of the present invention further includes a means (not shown) for computing a position of the golf assistant terminal 300 or further includes a storage unit that stores information used to compute the position of the golf assistant terminal 300. The means (not shown) for computing the position may be, for example, a GNSS receiver. The information used to compute the position may be an identifier inherently allocated to the. In this regard, the GNSS may be, for example, a satellite of an earth.

In the present specification, since the golf assistant carries the golf assistant terminal 300, it is assumed that a current position of the golf assistant terminal 300 is the same as a current position of the golf assistant. A means for obtaining position information such as the GNSS receiver or a storage unit for storing tag information in an RFID system or a Wi-Fi system is referred to as a "position computation information providing unit". That is, the position computation information providing unit obtains or previously stores information necessary for computing a position, and the information necessary for computing the position may be, for example, position information or tag information directly obtained from a satellite.

The information obtained by or previously stored in the position computation information providing unit is transmitted to the management server 200 through the communication unit 203.

As will be described later, according to an embodiment of the present invention, the golf shot information received in the golf assistant terminal 300 from the management server 200 is computed based on a position of the golfer, the motion detection result, and the information provided by the position computation information providing unit.

Referring to FIG. 4, the golf assistant terminal 300 according to an embodiment of the present invention includes a display unit 407 capable of displaying a golf shot accumulation par for each golfer, a means capable of correcting the golf shot accumulation par for each golfer, and a means (shown as a circular button) for acknowledging whether the golf shot accumulation par for each golfer is correct. The means capable of correcting the golf shot accumulation par for each golfer includes an increase unit in a triangular shape for inputting a command to increase a golf shot and a reduction unit in an inverse triangular shape for inputting a command to reduce the golf shot. Meanwhile, although an input unit 401 is shown as a button, the input unit 401 may be implemented as a touch pad.

According to an embodiment of the present invention, the display unit 407 of FIG. 4 displays an accumulation par of a current hole. In this case, if an acknowledgement command is input through a means that acknowledges whether a golf shot accumulation par is correct, the golf assistant terminal 300 transmits an acknowledgement signal indicating that the golf shots of the current hole are completely counted to the management server 200. To count golf shots in a next hole, the golf assistant terminal 300 sets the golf shot accumulation par for each golfer as "0".

According to another embodiment of the present invention, the display unit 407 of FIG. 4 displays the total accumulation par from a first hole to a current hole. In this case, if an acknowledgement command is input through a means of acknowledging whether the golf shot accumulation par is correct, the golf assistant terminal 300 transmits an acknowledgement signal indicating that golf shots in the current hole are completely counted to the management server 200. The golf shot par accumulated up to by the current hole is displayed.

A user interface unit of a golf assistant terminal according to an exemplary embodiment of the present invention will now be described with reference to FIG. 22.

Figure 22:
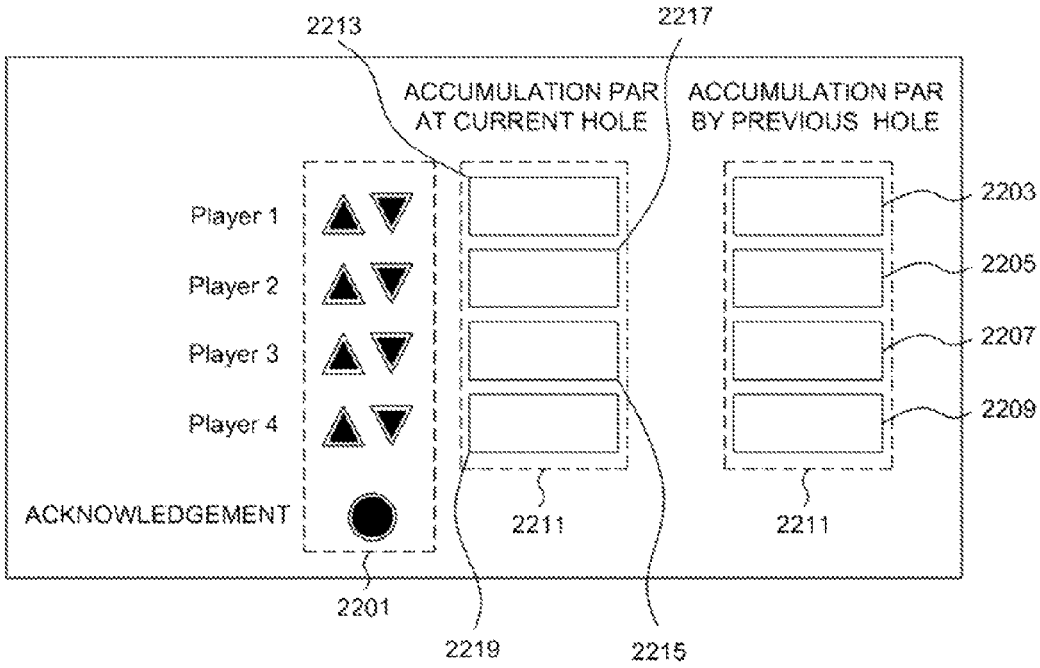
FIG. 22 is a diagram of a user interface unit of a golf assistant terminal according to another exemplary embodiment of the present invention.

FIG. 22 is a diagram of a user interface unit of a golf assistant terminal according to another exemplary embodiment of the present invention. Referring to FIG. 22, the golf assistant terminal includes parts 2211, 2213, 2215, 2217, and 2219 for displaying an accumulation par of a current hole for each golfer, parts 2222, 2203, 2205, 2207, and 2209 for displaying an accumulation par for each golfer by a previous hole, and a part 2201 capable of correcting the accumulation par and acknowledging the correctness of the accumulation par.

According to an embodiment of the present invention, if an acknowledgement command is input through a means of acknowledging whether a golf shot accumulation par is correct, the golf assistant terminal transmits an acknowledgement signal indicating that golf shots in a current hole (for example, a seventh hole) are completely counted to the management server 200. Then, to count golf shots in a next hole (i.e. an eighth hole), the parts 2211, 2213, 2215, 2217, and 2219 of displaying the accumulation par of the current hole are set as "0", and the parts 2222, 2203, 2205, 2207, and 2209 of displaying the accumulation par for each golfer by the previous hole display a par accumulated by the eighth hole.

Figure 8:
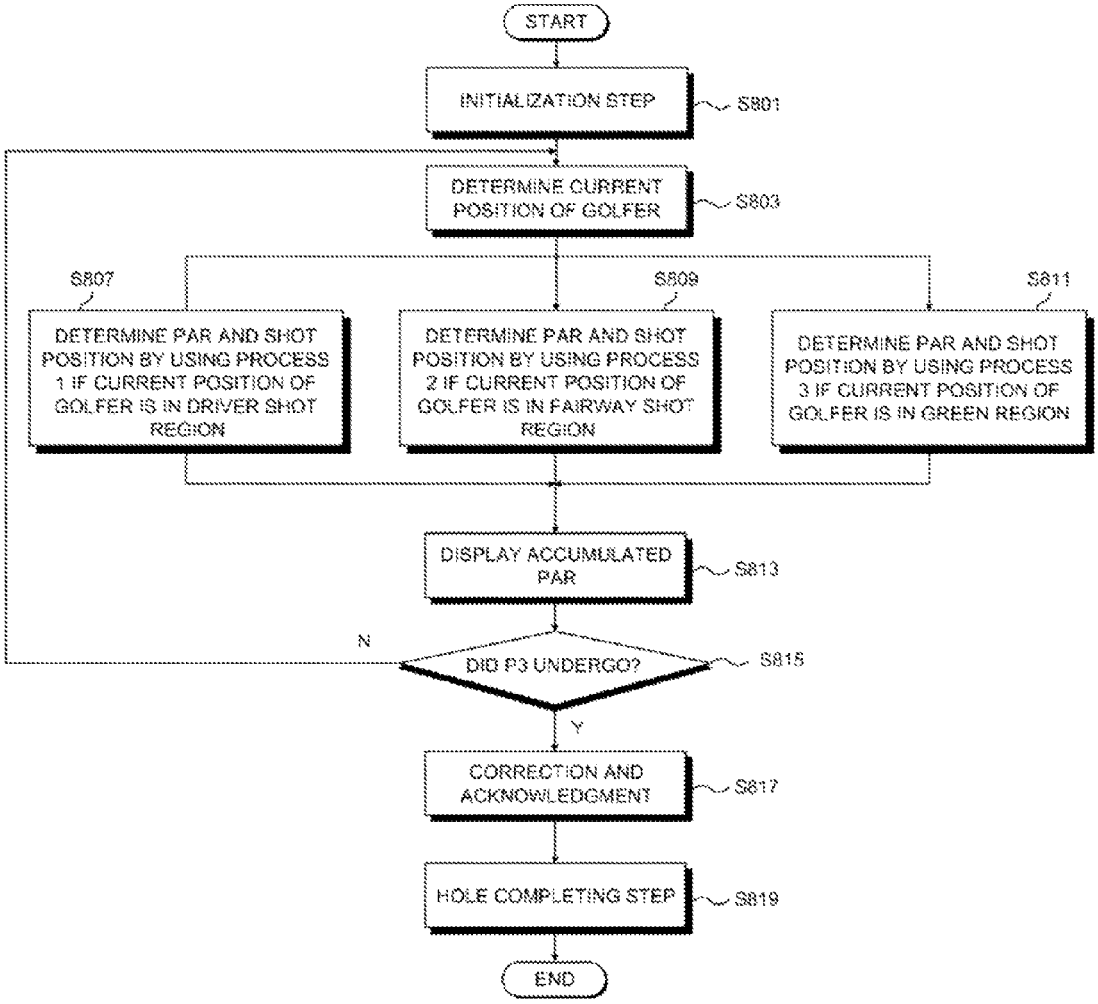
FIG. 8 is a flowchart of a method of managing a golf tournament in real time according to another exemplary embodiment of the present invention.

The embodiment of FIG. 8 is merely exemplary, and thus information regarding the accumulation par is displayed in a different way within the scope of the present invention.

Figure 3:
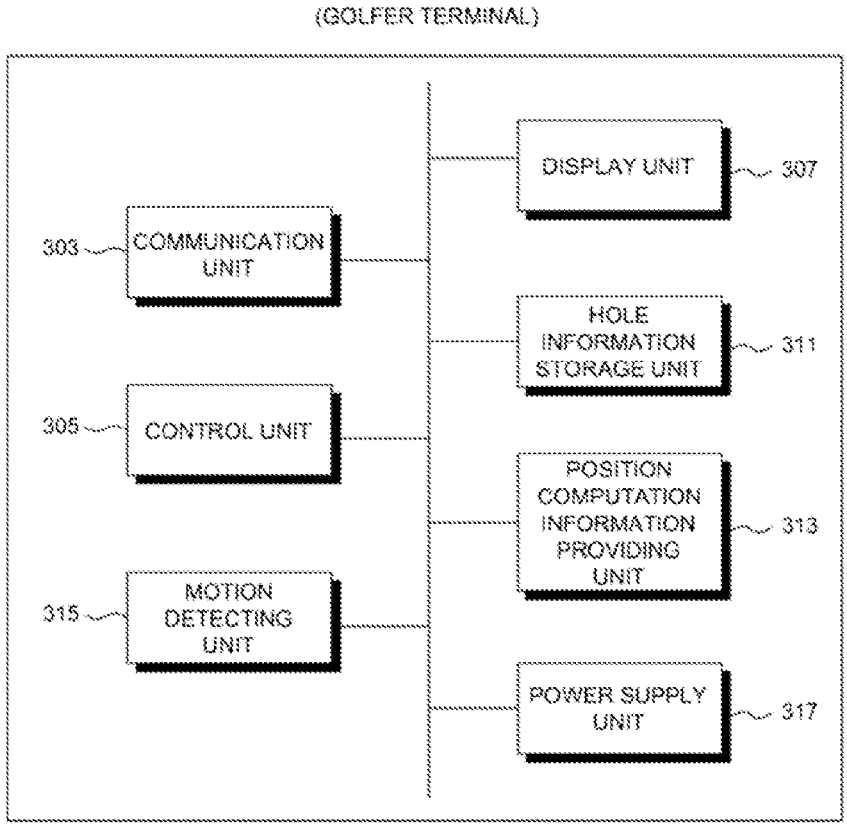
FIG. 3 is a block diagram of a golfer terminal according to an exemplary embodiment of the present invention.

FIG. 3 is a block diagram of a golfer terminal according to an exemplary embodiment of the present invention.

Referring to FIG. 3, the golfer terminal according to an embodiment of the present invention includes a communication unit 303, a control unit 305, a display unit 307, a hole information storage unit 311, a position computation information providing unit 313, a motion detecting unit 315, and power supply unit 317.

The communication unit 300 performs a communication with the management server 200. The display unit 307 displays the "remaining distance" calculated by the management server 200 or the golfer terminal **100*a* in real time. The hole information storage unit 311 stores position information of each hole cup. The position computation information providing unit 313** provides by obtaining or previously storing position information to calculate a position of a golfer.

The motion detecting unit 315 detects a motion of the golfer who carries the gofer terminal. The power supply unit 317 supplies power necessary for an operation of the golfer terminal **100*a*. For example, the power supply unit 317 may be a potable battery, or a charging unit for charging power from outside. Alternatively, the power supply unit 317** may be a connection unit for directly supplying power from outside (through wireless or wired).

In an embodiment where the golfer terminal **100*a* calculates the "remaining distance", the control unit 305 calculates the "remaining distance" by calculating a current position of the golfer based on the position computation information provided by the position computation information providing unit 313 and comparing the current position of the golfer and the position of the hole cup stored in the hole information storage unit 311**.

In an embodiment where the golfer terminal **100*a* receives and displays the "remaining distance" calculated by the management server 200, the communication unit 303 receives the "remaining distance" calculated by the management server 200, and the received "remaining distance" is displayed on the display unit 307**.

The motion detecting unit 315 detects a motion of the golfer and detects a motion that is assumed as a shot. For example, the motion detecting unit 315 detects a waist rotation or an up and down motion of the golfer.

According to an embodiment of the present invention, the remaining distance may be more accurately calculated by using correction data.

For example, when the control unit 3015 calculates the "remaining distance", the remaining distance is calculated by correcting a position computed from position computation information of the golfer by using the correction data, and comparing the corrected position of the golfer and the position information of the hole cup stored in the hole information storage unit 311. When the management server 200 calculates the "remaining distance", the remaining distance can be more accurately calculated through the same process as stated with respect to the control unit 305 above.

The communication unit 303 according to an embodiment of the present invention may receive golf shot information from the management server 200 in real time. The golf shot information may include the total accumulation par by a previous hole of a golfer and an accumulation par of a current hole of the golfer.

According to an embodiment of the present invention, the golfer terminal 100*a* may further include a golf shot sound detecting unit (not shown). The golf shot sound detecting unit may detect sound generated when a golf shot is hit. The sound generated when a golf club hits a golf ball may be special, for example, a "bang", "OK", or "nice putting", etc. and has a special distribution in a frequency band. Thus, the golf shot sound detecting unit may provide reliable information regarding whether the golf shot is hit.

A user interface unit of a golfer terminal according to an embodiment of the present invention will now be described with reference to FIG. 21.

Figure 21:
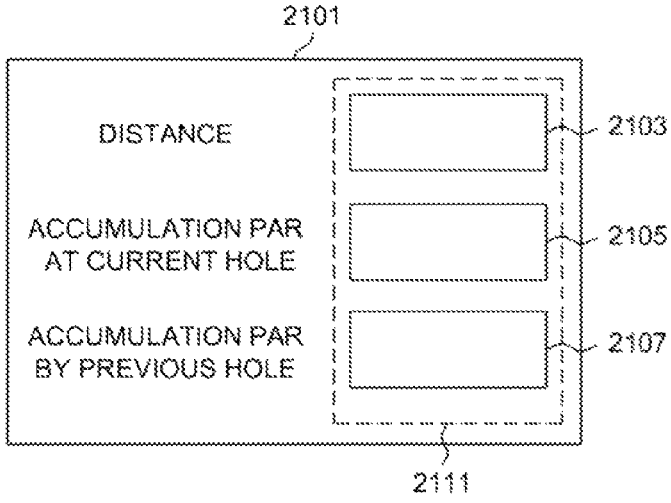
FIG. 21 is a diagram of a user interface unit of a golfer terminal according to an exemplary embodiment of the present invention.

FIG. 21 is a diagram of a user interface unit of a golfer terminal according to an exemplary embodiment of the present invention. Referring to FIG. 21, the golfer terminal includes a display unit 2111 including a part 2103 of displaying a remaining distance, a part 2105 of showing an accumulation par of a current hole, and a part 2107 of displaying an accumulation par by a previous hole. The embodiment of FIG. 21 is merely exemplary, and thus information regarding the remaining distance or the accumulation par is displayed in a different form to the golfer within the scope of the present invention.

According to an embodiment of the present invention, golf shot information received by the golfer terminal 100*a* from the management server 200 is computed based on the position computation information, the motion detection information, or the sound detection information transmitted from the golfer terminal 100*a* to the management server 200.

In the present invention, the position computation information providing unit included in the golf assistant terminal 300 or the golfer terminals 100*a*, 100*b*, 100*c*, and 100*d* may, for example, include the following.

1) The position computation information providing unit according to an embodiment of the present invention includes a GNSS receiver. When the position computation information providing unit includes the GNSS receiver, the position computation information providing unit can obtain current position information.

2) The position computation information providing unit according to another embodiment of the present invention includes two functional modules one embedded in the golfer terminals 100*a*, 100*b*, 100*c*, and 100*d*, and another located on a green region, a fairway region, or a driver shot region. Likewise, the position computation information providing unit of the golf assistant terminal 300 includes two functional modules one embedded in the golf assistant terminal 300 and another one located on the green region, the fairway region, or the driver shot region. Position information of a golf assistant may be computed through correlation between the two functional modules.

These two functional modules will now be described.

The two functional modules are a tag and a reader. An identifier ID that is allocated to the tag only is stored in the tag. The reader may read the identifier ID stored in the tag wirelessly. The reader communicates with the tag. For example, one or more readers may be located on appropriate positions of a golf resort. In the tag and reader system, the identifier ID inherently allocated to the tag and an identifier ID inherently allocated to the position computation information providing unit may be identical or different. The tag and the reader may compute a position of the tag by using a communication time therebetween. In this way, a technology of computing the position by using the tag and the reader is widely known, and thus a detailed description thereof will now be provided.

In the present invention, a technology of detecting a position (exactly, a position of the golfer terminal) of a golfer or a position (a position of the golfer terminal) of the golf assistant terminal may exist, in addition to the GNSS and the tag and reader system. The present invention utilizes a currently known technology or a future developed technology of detecting the position, and thus all systems for detecting the position may be used in the present invention. The system for detecting the position is referred to as a position information providing unit in the present specification. The position information providing unit may include a GNSS receiver like the GNSS stated above, or two functional constituents like the tag and reader system. Furthermore, the system is used to refer to a system for computing the position irrespective of how many functional constituents are included therein.

The golfer terminal and the golf assistant terminal according to an embodiment of the present invention may further include a power reduction unit (not shown).

According to an embodiment of the present invention, the golfer terminal may adjust power supplied to at least some of the constituents included in the golfer terminal when a specific event occurs.

Typically, the golfer terminal according to the present invention may adjust power on the display unit 307. For example, when a specific event occurs or does not occur, the golfer terminal supplies power to the display unit 307 and displays the power thereon. For another example, the golfer terminal supplies power to the position computation information providing unit 313, the communication unit 303, or the control unit 305 irrespective of an occurrence of the event and thus, the position computation information providing unit 313, the communication unit 303, or the control unit 305 always operates. Unlike, the golfer terminal supplies power to a part of the display unit 307 that displays the remaining distance and does not supply power to a part thereof that displays the accumulation par or a current par. For example, referring to FIG. 21 that will be described, a part 2103 of displaying the remaining accumulation par is displayed only when a specific event occurs or does not occur.

The specific event may be, for example, one of the followings or a combination thereof.

1) When a golfer enters into a specific region or comes out therefrom: the specific region may be a driver shot region, a fairway region, or a green region, etc. and may be a road used by a cart.

2) When a golfer terminal or a golf assistant terminal moves as a previously defined motion: for example, the golfer terminal can be worn on a waist of a golfer. A display unit of the golfer terminal moves toward the golfer to see the golfer terminal. This motion is simple and fixed, and thus a distance and angle of the motion may be fixed data. Thus, it is possible to previously prepare reference data corresponding to the motion.

Now, a method of recognizing a specific event will now be described in detail.

The method of recognizing the specific event may include i) a method of receiving a command from a user, ii) a method of recognizing the specific event by an intelligent process, or iii) a method of physically detecting a movement of a golfer terminal.

First, the method of receiving the command from the user can be performed by additionally including an input unit (not shown) (a switch or a touch pad, etc.) of the golfer terminal or the golf assistant terminal of inputting the command from the user. If there is a command relating to a power reduction from the user through the input unit, a control unit may recognize the power reduction command, and control an operation of a power unit.

Second, the method of recognizing the specific event by the intelligent process can recognize that a golfer or a golf assistant has entered into a specific region based on position computation information. To this end, the control unit may control the operation of the power unit based on information regarding a current region received from the management server 200. Another method of determining whether the golfer terminal or the golf assistant terminal moves in a previously defined motion can be detected by a motion detecting unit. Thus, if the motion detecting unit detects the golfer terminal or the golf assistant terminal to move in the previously defined motion, the control unit may control the operation of the power unit based on a detection result. For example, the control unit may determine whether the specific event occurs by comparing the detection result detected by the motion detecting unit and the reference data corresponding to the previously defined motion.

Figure 26:
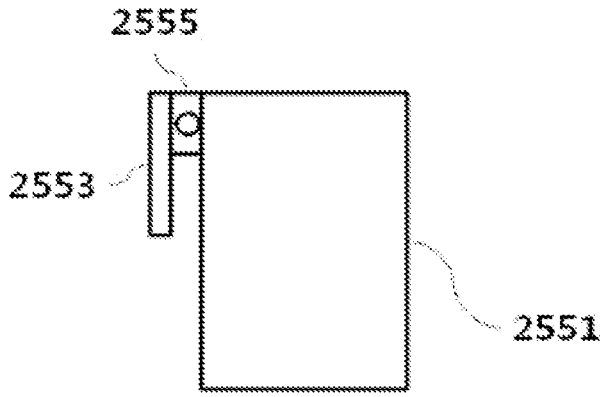
FIG. 26 illustrates a golfer terminal according to another exemplary embodiment of the present invention.
Figure 27:
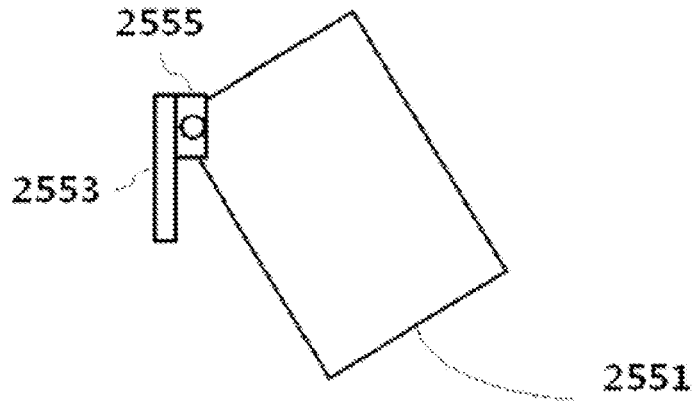
FIG. 27 illustrates an operation of the golfer terminal of FIG. 26.
Figure 28:
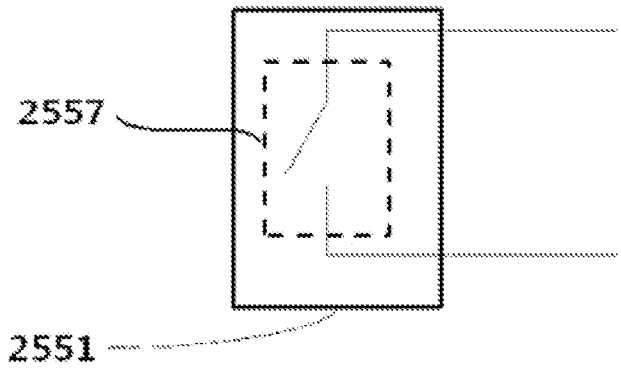
FIG. 28 illustrates a contact device of the golfer terminal of FIG. 26.

Third, the method of physically detecting the movement of the golfer terminal is a method of detecting whether the golfer terminal moves in a specific motion by using a change of an electrical signal. This will now be described with reference to FIGS. 26 through 28. FIGS. 26 through 28 illustrate a golfer terminal worn on a waist. The golfer terminal includes a terminal body 2551, a hook 2553 for fixing the golfer terminal to the waist, and a connection unit 2555 for connecting the terminal body 2551 and the hook 2553. The connection unit 2555 may be rotated and thus the terminal body 2551 can rotate. The terminal body 2551 may include, for example, the elements shown in FIG. 3.

Referring to FIG. 27, the terminal body 2551 can rotate, and thus a golfer can easily see an image displayed on the terminal body 2551. Meanwhile, according to an embodiment of the present invention, power is supplied on a display unit of the golfer terminal when the terminal body 2551 rotates according to an arrow as shown in FIG. 27, and power is not supplied to the display unit when the terminal body 2551 is located as shown in FIG. 26.

A method of detecting the movement, of the terminal body 2551 uses a motion sensor as described above. However, as shown in FIG. 28, a specific movement of the golfer terminal can be detected by detecting whether an electrical contact is turned on or off by using the electrical contact device 2257.

Figure 5:
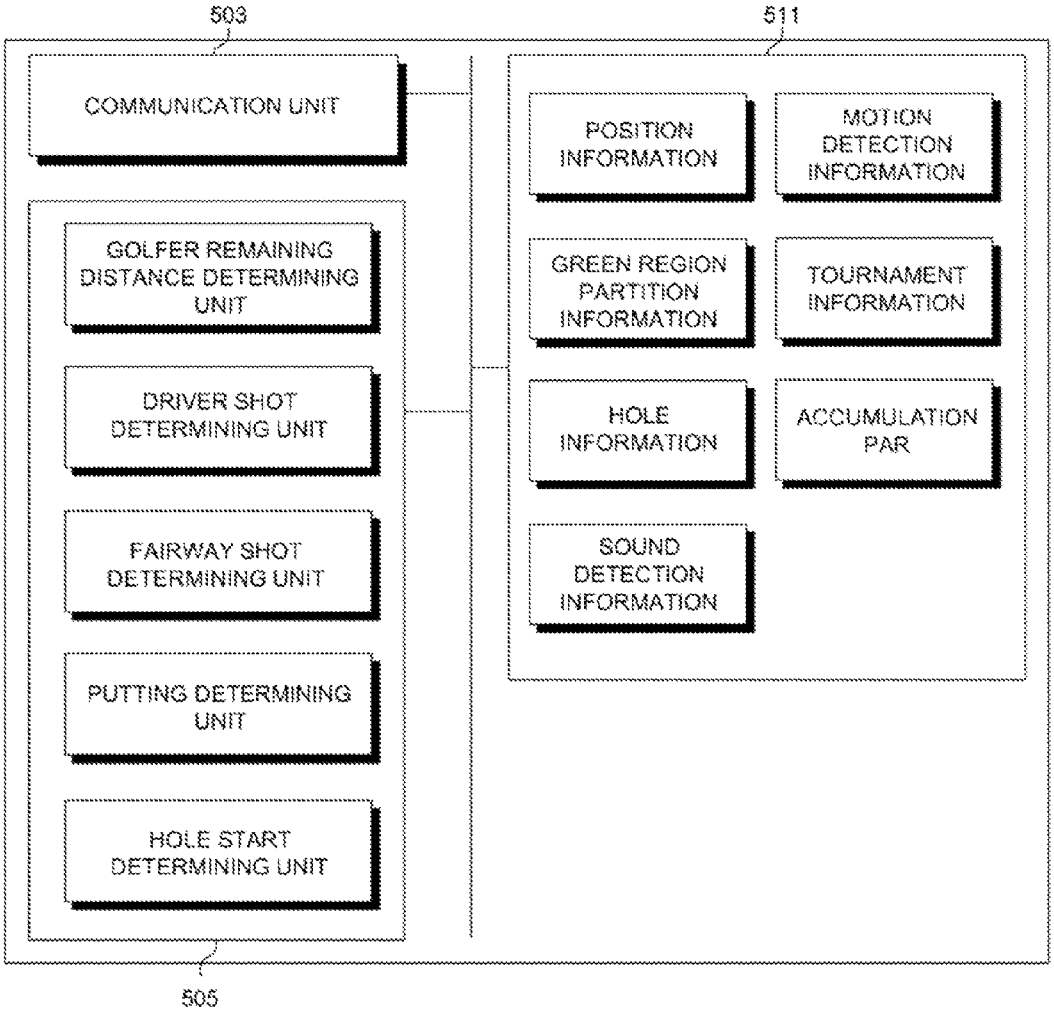
FIG. 5 is a block diagram of a management server according to an exemplary embodiment of the present invention.

FIG. 5 is a block diagram of a management server according to an exemplary embodiment of the present invention.

Referring to FIG. 5, the management server according to an embodiment of the present invention includes a communication unit 503, a storage unit 511, and a control unit 505.

The communication unit 503 communicates with the golfer terminal 100*a* or the golf assistant terminal 300.

The communication unit 503 receives position computation information of a golfer from the golfer terminal 100*a*, and transmits golf shot information computed based on the received position computation information to the golf assistant terminal 300. The communication unit 503 may additionally transmit the golf shot information computed based on the position computation information to the golfer terminal 100*a*.

The control unit 505 counts, stores, and manages an accumulation par of the golfer and records (stores) and manages a shot position.

The control unit 505 according to an embodiment of the present invention may perform the following operations:

1) A "remaining distance" is calculated in real time based on position computation information received from the golfer terminal 100*a*.

2) It is determined whether a driver shot counting condition is satisfied, if the driver shot counting condition is satisfied, driver shots are counted, and a position of the driver shot is recorded.

3) It is determined whether a fairway shot counting condition is satisfied, if the fairway shot counting condition is satisfied, fairway shots are counted, and a position of the fairway shot is recorded.

4) It is determined whether a putting shot counting condition is satisfied, if the putting shot counting condition is satisfied, putting shots are counted, and a position of the putting shot is recorded.

5) It is determined whether a golfer moves to a new hole, if the golfer moves to the new hole, counting of golf shots by a previous hole is completed, and counting of golf shots in the new hole starts.

The storage unit 511 stores data necessary for an operation of the control unit 505 or computed data.

For example, the storage unit 511 may store "position information", "motion detection information", "green region partition information", "tournament information", "hole information", "accumulation par", and "sound detection information". Although the information may be stored in a physically one storage means, the information may be stored in physically different storage means.

The "position information" is position information of all times during a golf tournament of the golfer. That is, the position information is information regarding a position of the golfer for each time during the golf tournament from a first hole to a final hole. Golfer position information includes position information regarding each golfer.

Also, the "position information" may further include information regarding a position of the golf assistant for all times (when the golf tournament is being played). That is, the position information may include information regarding a position of the to golf assistant for each time during the golf tournament from a first hole to a final hole.

The "position information" is received in real time and stores. The position information regarding the golfer is received through the golfer terminal 100*a*. The position information regarding the golf assistant is received through the golf assistant terminal 300.

The "motion detection information" is information regarding a motion of the golf assistant and a motion of the golfer. The information is received through the golf assistant terminal 300 and the golfer terminal 100*a*, respectively. The "motion detection information" includes information regarding an up and down movement of the golf assistant and information regarding a waist movement and an up and down movement of the golfer.

The "green region partition information" is information regarding a green that is virtually partitioned into a predetermined number of regions. According to an embodiment of the present invention, the partitioned green regions may include a region (hereinafter, referred to as the "N region") within a radius N[m] with respect to a cup, a region (hereinafter, referred to as the "M region") between the radius N[m] and M[m] with respect to the cup, and a region (hereinafter, referred to as the "F region") beyond M[m] with respect to the cup. In the present specification, the partitioned green regions, i.e. the N region, the M region, and the F region, are referred to as "base regions".

The partitioned green regions may be circular or oval, and may be partitioned in appropriate shapes according to a shape of a green region. The partitioned green regions are virtual and are not actually partitioned and are virtually partitioned into some regions based on position information of the green region. That is, the "green region partition information" is information regarding the green region virtually partitioned into some regions. The "green region partition information" is a basis for determining a partition including a ball located in the green region. Meanwhile, first default putting numbers are allocated to the base regions and are included in the "green region partition information". For example, a first default putting number of the F region is allocated as +3, the first default putting number of the M region is allocated as +2, and the first default putting number of the N region is allocated as +1. In this way, the default putting numbers are optionally decided, mainly according to a tournament experience. The first default putting number of the F region is that the F region is far away from the cup, and thus is decided as +3 according to the tournament experience that three putting shots are generally necessary. The first default putting number of the F region may be decided as +2 or +4 according to a topographical characteristic or an angle of a green region of a golf resort.

The first default putting number of the M region is that the M region is slightly away from the cup, and thus is decided as +2 according to the tournament experience that two putting shots are generally necessary. Likewise, the first default putting number of the M region may be decided differently according to the topographical characteristic or the angle of the green region of the golf resort.

The first default putting number of the N region is that the M region is closer from the cup, and thus is decided as +1 according to the tournament experience that two putting shots are generally necessary. Likewise, the first default putting number of the N region may be decided differently according to the topographical characteristic or the angle of the green region of the golf resort.

Although the base regions are 3 in the present embodiment, alternatively two or four or more base regions may be determined, and the first default putting number may be allocated according to the characteristics of the green region of each base region.

In the present specification, the "green region" means a region for putting, and indicates a region where a cup is generally located.

The "tournament information" means tournament information of the golfer. For example, a name of the golfer, the number of holes (for example, 9 holes, 19 holes, 27 holes, or 36 holes, . . . ), a teeing up time, a sex of the golfer, a car number of the golfer, and the like.

The "hole information" is information regarding a position of a hole being played. For example, the "hole information" may include position information (for example, a position coordinate) regarding a position of each hole. For example, the "hole information" may include position information regarding a driver shot region, position information regarding a fairway region, and position information regarding a green region.

The "accumulation par" is golf shot information of a golfer and is information to regarding an accumulation par for each golfer and hole, and an accumulation par by a current hole.

The "sound detection information" is information regarding sound assumed as a shot detected by the golfer terminal 100*a*. The "sound assumed as the shot" may be sound generated when a golf club hits a ball, and may be sound like "OK" or "nice putting" when a putting shot is hit.

The storage unit 511 according to an embodiment of the present invention may additionally store motion reference information and sound reference information. The motion reference information, which is a kind of sample data, is shot motion data detected at a waist movement. The sound reference information which is a kind of sample data is sound data generated when a shot is hit.

For example, the motion reference information is sample data accumulated through many shot operations, may be female or male shot motion data, and may be shot motion data for each age. The motion reference information may be a plurality of pieces of shot motion data, and may be shot motion data obtained by artificially performing a shot operation. Unlike, the motion reference information may be information obtained by accumulating shot motion data of actual golfers.

The motion reference information may be stored after being classified as, for example, driver shot motion data, fairway shot motion data, or putting shot motion data.

The sound reference information is also sample data accumulated through many shot operations, may be female or male shot sound data, and may be shot sound data for each age. The sound reference information may be a plurality of pieces of shot sound data, and may be shot sound data obtained by artificially performing a shot operation. Unlike, the sound reference information may be information obtained by accumulating shot sound data of actual golfers.

The sound reference information may be stored after being classified as, for example, driver shot sound data, fairway shot sound data, or putting shot sound data.

The control unit 505 according to an embodiment of the present invention may determine the remaining distance of a golfer, determine whether a driver shot is hit, and determine whether a fairway shot is hit as shown in FIG. 5. Also, the control unit 505 may determine whether a putting shot is hit, and determine whether a new hole is resumed.

As described above, the control unit 505 may calculate the remaining distance by comparing a current position of a golfer and a previously stored position of a cup. The control unit 505 may be informed of the current position of the golfer from information received from the golfer terminal 100*a* in real time or the "position information" previously stored in the storage unit. The previously stored position of the cup may be informed of the hole information stored in the storage unit 511.

The control unit 505 may decide a driver shot counting condition by determining whether the current position of the golfer is in the driver shot region, determining whether there is a waist movement of the golfer, or determining whether there is golf shot sound, etc.

The control unit 505 may use one of the following methods or a combination thereof to determine the driver shot counting condition.

First, the control unit 505 according to an embodiment of the present invention may determine the driver shot counting condition is satisfied if the current position of the golfer stays in the driver shot region for a predetermined period of time and comes out the driver shot region, count driver shots, and record a position of the driver shot.

Second, the control unit 505 according to another embodiment of the present invention may determine that the driver shot counting condition is satisfied if the current position of the golfer is in the driver shot region, and there is a driver shot estimated motion (for example, a movement of spinning a waist) of the golfer, count driver shots, and record the position of the driver shot.

Third, the control unit 505 according to another embodiment of the present invention may determine that the driver shot counting condition is satisfied if the current position of the golfer is in the driver shot region, and there is driver shot estimated sound of the golfer, count driver shots, and record the position of the driver shot. Whether there is the driver shot estimated sound may be determined by comparing the sound detection information measured by the golfer terminal 100*a* and the previously stored sound reference information.

Fourth, the control unit 505 according to another embodiment of the present invention may determine that the driver shot counting condition is satisfied if the current position of the golfer is in the driver shot region, there is the driver shot estimated sound of the golfer, and there is the driver shot estimated motion of the golfer, count driver shots, and record the position of the driver shot.

The control unit 505 may use one of the following methods or a combination thereof to determine the fairway shot counting condition.

First, the control unit 505 according to an embodiment of the present invention may determine the fairway shot counting condition is satisfied if the current position of the golfer stays at a region of the fairway region for a predetermined period of time and comes out the region, count fairway shots, and record the region where the current position of the golfer stays for the predetermined period of time as a position of the fairway shot.

Second, the control unit 505 according to another embodiment of the present invention may determine that the fairway shot counting condition is satisfied if the current position of the golfer is in the fairway shot region, and there is a fairway shot estimated motion (for example, a movement of spinning a waist) of the golfer, count fairway shots, and record the position of the fairway shot. Whether there is the fairway shot estimated motion may be determined by comparing the motion detection information measured by the golfer terminal 100*a* and the previously stored motion reference information. The control unit 505 may determine if the golfer performs the operation of spinning the waist at least two times from the motion detection information measured by the golfer terminal 100*a*, if the golfer performs the operation of spinning the waist at least two times, record a position where the operation of spinning the waist is performed as a shot position, and count fairway shots.

Third, the control unit 505 according to another embodiment of the present invention may determine that the fairway shot counting condition is satisfied if the current position of the golfer is in the fairway shot region, and there is fairway shot estimated sound of the golfer, count fairway shots, and record the position of the fairway shot. Whether there is the fairway shot estimated sound may be determined by comparing the sound detection information measured by the golfer terminal 100*a* and the previously stored sound reference information. In this regard, the recorded position of the fairway shot is a position where the fairway shot estimated sound is generated.

Fourth, the control unit 505 according to another embodiment of the present invention may determine that the fairway shot counting condition is satisfied if the current position of the golfer is in the fairway shot region, there is the fairway shot estimated sound of the golfer, and there is the fairway shot estimated motion of the golfer, count fairway shots, and record the position of the fairway shot. In this regard, the recorded position of the fairway shot is a position where the shot estimated motion and the shot estimated sound are simultaneously generated.

The control unit 505 may use one of the following methods or a combination thereof to determine the putting shot counting condition.

First, the control unit 505 according to an embodiment of the present invention may determine the putting shot counting condition is satisfied if the current position of the golfer stays at a region of the green region for a predetermined period of time and comes out the region, count putting shots, and record the region where the current position of the golfer stays for the predetermined period of time as a position of the putting shot. If the golfer stays at the region of the green region for the predetermined period of time and the golf assistant also stays at the region of the green region for the predetermined period of time, the control unit 505 records the region where the golfer and the golf assistant stays for the predetermined period of time as a position of the putting shot and counts putting shots.

Second, the control unit 505 according to another embodiment of the present invention may determine that the putting shot counting condition is satisfied if the current position of the golfer is in the putting shot region, and there is a putting shot estimated motion (for example, an up and down motion or a waist spinning motion) of the golfer or a putting shot assistance estimated motion (for example, an up and down motion) of the golf assistant, count putting shots, and record the position of the putting shot. Whether there is the putting shot estimated motion or the putting shot assistance estimated motion may be determined by comparing the motion detection information to measured by the golfer terminal 100*a* and the golf assistant terminal 300 and the previously stored motion reference information. The control unit 505 may determine if the golfer did the up and down motion and the golf assistant did the up and down motion from the motion detection information measured by the golfer terminal 100*a*, if the golfer and the golf assistant did the up and down motion, record a position where the golfer and the golf assistant did the up and down motion as a putting shot position, and count putting shots.

Third, the control unit 505 according to another embodiment of the present invention may determine that the putting shot counting condition is satisfied if the current position of the golfer is in the green region, and there is putting shot estimated sound of the golfer, count putting shots, and record the position of the putting shot. In this regard, the recorded position of the putting shot is a position where the putting shot estimated sound is generated.

Fourth, the control unit 505 according to another embodiment of the present invention may determine that the putting shot counting condition is satisfied if the current position of the golfer is in the green region, there is the putting shot estimated sound of the golfer, and there is the putting shot estimated motions of the golfer and the golf assistant, count putting shots, and record the position of the putting shot. In this regard, the recorded position of the putting shot is a position where the putting shot estimated motion and the putting shot estimated sound are simultaneously generated.

Fifth, the control unit 505 according to another embodiment of the present invention may determines if the putting shot counting condition is satisfied in consideration of the green region partition information, the put shot estimated sound, and the putting shot estimated motion. A method of using the green region partition information will be described with reference to the drawings (FIGS. 13 through 20) later.

The control unit 505 completes the counting of shots and registration of positions in a corresponding hole if acknowledgement information is received from the golf assistant terminal 300. If the acknowledgement information is not received until the golfer enters a new hole and hits a driver shot, the control unit 505 determines that the golfer moves to the new hole, completes counting of previous golf shots, and completes the registration of the position. Thereafter, the control unit 505 performs operations of counting golf shots and recording a position in the new hole.

The motions such as the "driver shot estimated motion", the "fairway shot estimated motion", the "putting shot estimated motion", the "putting shot assistance estimated motion", etc. used in the present specification are used to mean all motions detected by the motion detecting unit. For example, the "driver shot estimated motion", the "fairway shot estimated motion", and the "putting shot estimated motion" may be a waist spinning motion or an up and down motion, and the "putting shot assistance estimated motion" may be an up and down motion of the golf assistant.

Also, the sound such as the "driver shot estimated sound", the "fairway shot estimated sound", the "putting shot estimated sound", etc. used in the present specification are used to mean sound detected by the sound detecting unit.

Meanwhile, information regarding whether the golfer leaves a specific region or whether the golfer enters into the specific region and how long the golfer stays in the specific region is computed based on position information of the golfer, and thus the information is conceptually distinguished from the shot estimated motions stated above. Likewise, information regarding a region where the golf assistant stays and how long the golf assistant stays is also conceptually distinguished from the putting shot assistance estimated motion.

Figure 6:
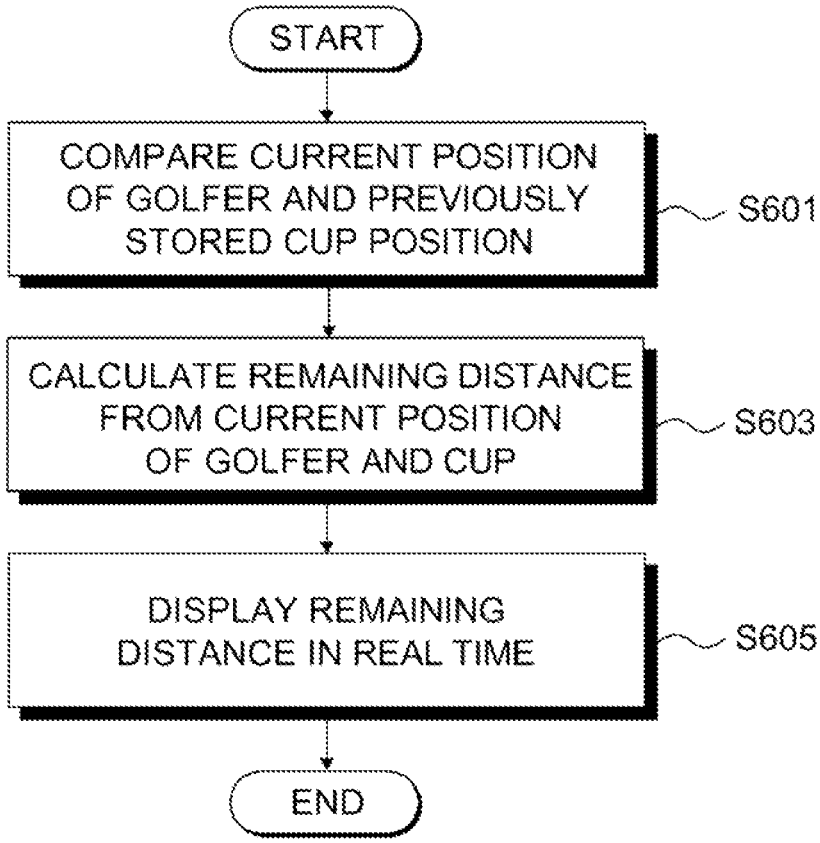
FIG. 6 is a flowchart of calculating a remaining distance according to an exemplary embodiment of the present invention.

FIG. 6 is a flowchart of calculating a remaining distance according to an exemplary embodiment of the present invention.

Referring to FIG. 6, a current position of a golfer and a previously stored cup position are compared (S601), the remaining distance between the current position of the golfer and the previously stored cup position may be calculated (S603), and the calculated remaining distance may be displayed in real time (S605).

The process of calculating the remaining distance may be performed by the golfer terminal 100*a* or the management server 200. The remaining distance calculated by the management server 200 is transmitted to the golfer terminal 100*a*. If the remaining distance is calculated by the golfer terminal 100*a*, the calculated remaining distance may be optionally transmitted to the management server 200.

The remaining distance calculated in S605 is displayed on the golfer terminal 100*a* in real time, and may be optionally displayed on the golf assistant terminal 300.

Figure 7:
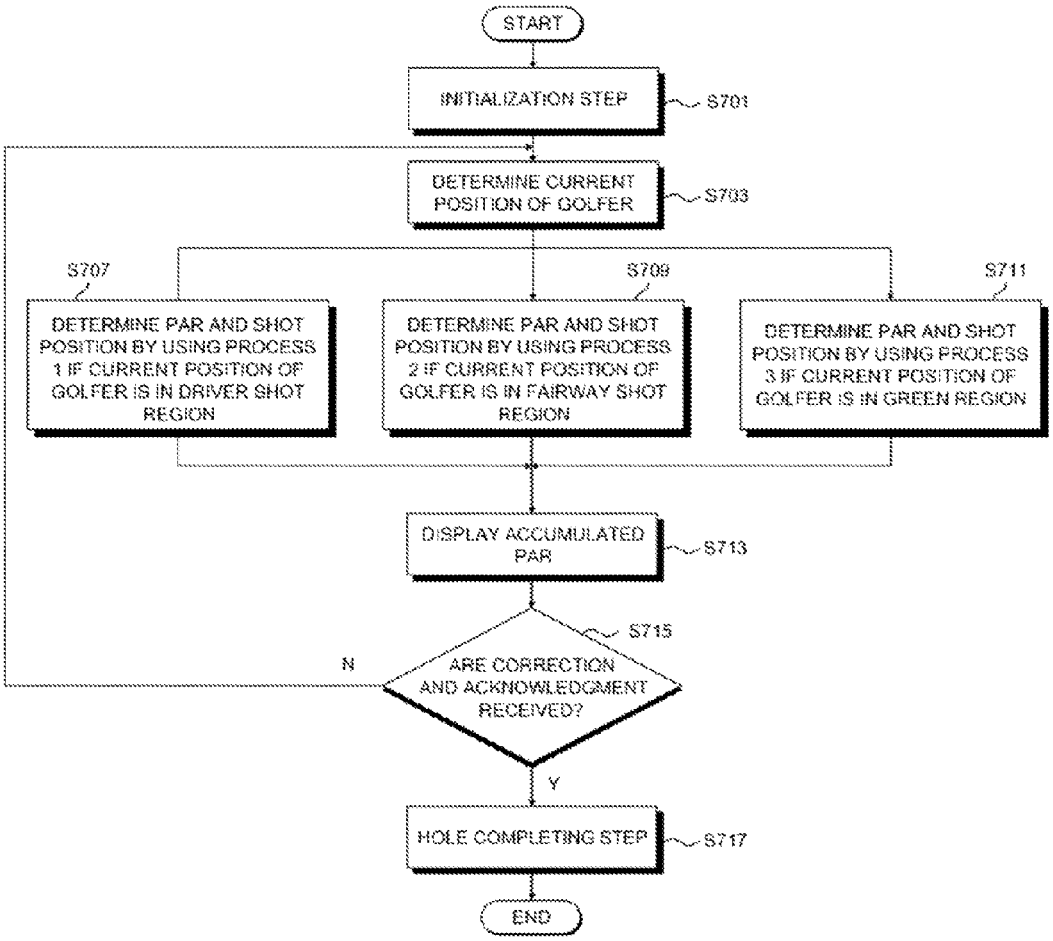
FIG. 7 is a flowchart of a method of managing a golf tournament in real time according to an exemplary embodiment of the present invention.

FIG. 7 is a flowchart of a method of managing a golf tournament in real time according to an exemplary embodiment of the present invention.

Referring to FIG. 7, if a new hole is started, an initialization step is performed (S701). In the initialization step, an accumulation par in the current hole displayed on the golf assistant terminal 300 is set as "0", and an accumulation par by a previous hole is finally stored. The start of the new hole is resumed if there is an acknowledgement signal from the golf assistant terminal 300 or if the management server 200 determines the new hole.

The new hole is started if there is an acknowledgement signal from the golfer terminal 100*a* or the management server 200 determines the new hole.

The management server 200 may determine a current position of the golfer based on position computation information received in real time through the golfer terminal 100*a* (S703). The management server 200 according to an embodiment of the present invention may determine if the current position of the golfer is in a driver shot region according to whether the golfer is a male or a female. Usually, a driver shot region used by the male and a driver shot region used by the female are different and are previously determined before the golf tournament starts. Thus, the management server 200 may determine whether the current position of the golfer is in the driver shot region by determining whether the golfer is the male or the female using tournament information stored in the storage unit 511. Determination of whether the golfer in the driver shot region is the male or the female is possible since an inherent identifier is allocated to the golfer terminal 100*a*, and the tournament information stored in the storage unit 511 stores the identifier for each golfer.

The management server 200 determines a par and a shot position by using a process 1 (of determining if a driver shot counting condition is satisfied) if the current position of the golfer is in the driver shot region (S707), determines the par and the shot position by using a process 2 (of determining if a fairway shot counting condition is satisfied) if the current position of the golfer is in a fairway region (S709), and determines the par and the shot position by using a process 3 (of determining if a putting shot counting condition is satisfied) if the current position of the golfer is in a green region (S711).

The par accumulated by the management server 200 is displayed on the golf assistant terminal 300, and may be optionally displayed on the golfer terminal 100*a* (S713). In this regard, the displayed par may be at least one of the accumulation par of the current hole and the total accumulation par by the previous hole.

If a correction command is input through the golf assistant terminal 300 (S715: YES), the golf assistant terminal 300 displays the par according to the correction command again, and transmits the correction command to the management server 200. The management server 200 corrects the accumulated par according to the correction command. According to an embodiment of the present invention, if the correction command of correcting the accumulation par as −1 is input, the management server 200 corrects the accumulation par as −1, and cancels the position recorded with a final putting shot. If the correction command of correcting the accumulation par as +1 is input, the management server 200 may correct the accumulation par as +1, and arbitrarily add a putting shot position.

If an acknowledgement command (or an "acknowledgement signal") is input through the golf assistant terminal 300 (S715: YES), the golf assistant terminal 300 sets the displayed accumulation par of the current hole as "0", and displays the par accumulated by the previous hole as a par accumulated by up to now. The golf assistant terminal 300 transmits the acknowledgment command to the management server 200. The management server 200 completes the accumulation of par in a corresponding hole and the registration of a position and performs an initialization operation.

FIG. 8 is a flowchart of a method of managing a golf tournament in real time according to another exemplary embodiment of the present invention.

FIG. 8 is almost similar to FIG. 7 and is different from FIG. 7 in that S825 is additionally performed. That is, in FIG. 3, only if the management server 200 completely performs process P3 (i.e. a putting shot counting condition is completed), the correction and acknowledgement operation (S817) may be performed.

Figure 9:
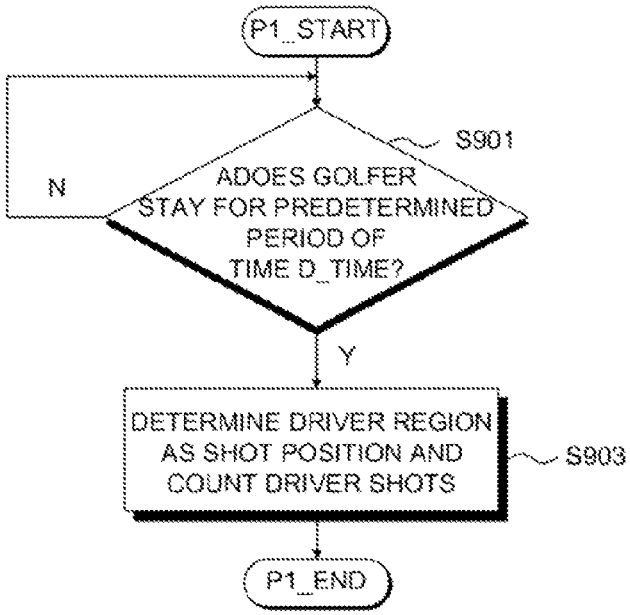
FIG. 9 is a flowchart of a method of determining whether a driver shot is hit and determining a position of the driver shot according to an exemplary embodiment of the present invention.

FIG. 9 is a flowchart of a method of determining whether a driver shot is hit and determining a position of the driver shot according to an exemplary embodiment of the present invention.

Referring to FIG. 9, a process of performing a driver shot counting condition is shown. The management server 200 records a driver shot region as the position of the driver shot and counts driver shots (S903) only when a golfer stays in a driver region for a predetermined period of time D_Time (S901:YES). In this regard, the predetermined period of time D_Time may be determined in consideration of, for example, time taken to hit the driver shot and make a preliminary motion (a preliminary swing) to hit the driver shot. For example, the predetermined period of time D_Time may be more than 3 seconds.

Figure 10:
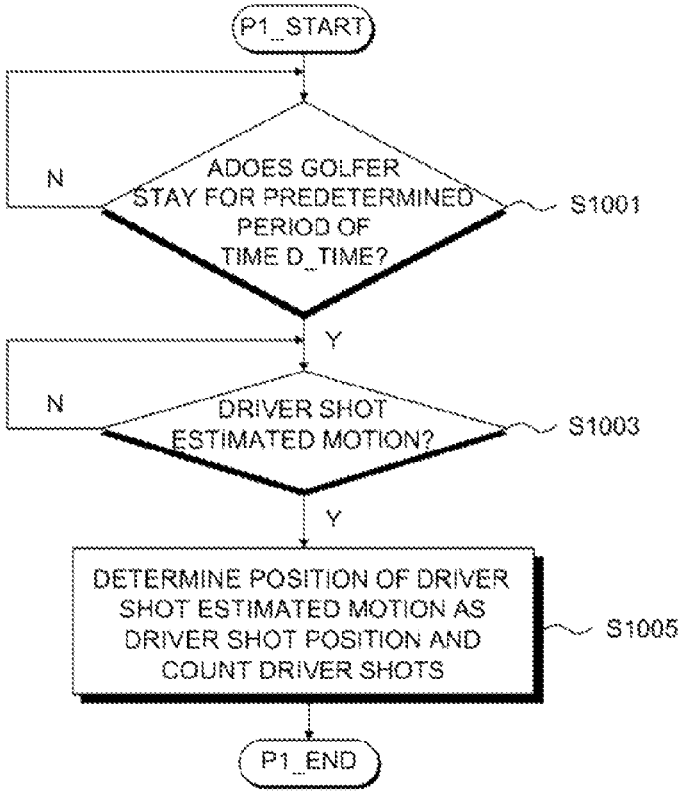
FIG. 10 is a flowchart of a method of determining whether a driver shot is hit and determining a position of the driver shot according to another exemplary embodiment of the present invention.

FIG. 10 is a flowchart of a method of determining whether a driver shot is hit and determining a position of the driver shot according to another exemplary embodiment of the present invention.

Referring to FIG. 10, the management server 200 records a golfer position in a driver region as a driver shot position and counts driver shots (S1005) if a golfer stays in the driver region for the predetermined period of time D_Time (S1001: YES), and there is a driver shot estimated motion (for example, a waist motion).

The embodiment of FIG. 10 may have carious modifications. For example, if the golfer stays in the driver region for the predetermined period of time D_Time, and there are the driver shot estimated motion (for example, the waist motion) and driver shot estimated sound, the management server 200 records the golfer position as the driver shot position when there is the driver shot estimated motion and counts driver shots (S1005).

As another modification, for example, if the golfer stays in the driver region for the predetermined period of time D_Time, and there is the driver shot estimated sound, the management server 200 records the golfer position as the driver shot position when there is the driver shot estimated sound and counts driver shots (S1005).

As another modification, for example, if there is the driver shot estimated sound or the driver shot estimated motion, the management server 200 records the golfer position when there is the driver shot estimated sound or when there is the driver shot estimated motion as the driver shot position and counts driver shots (S1005).

Figure 11:
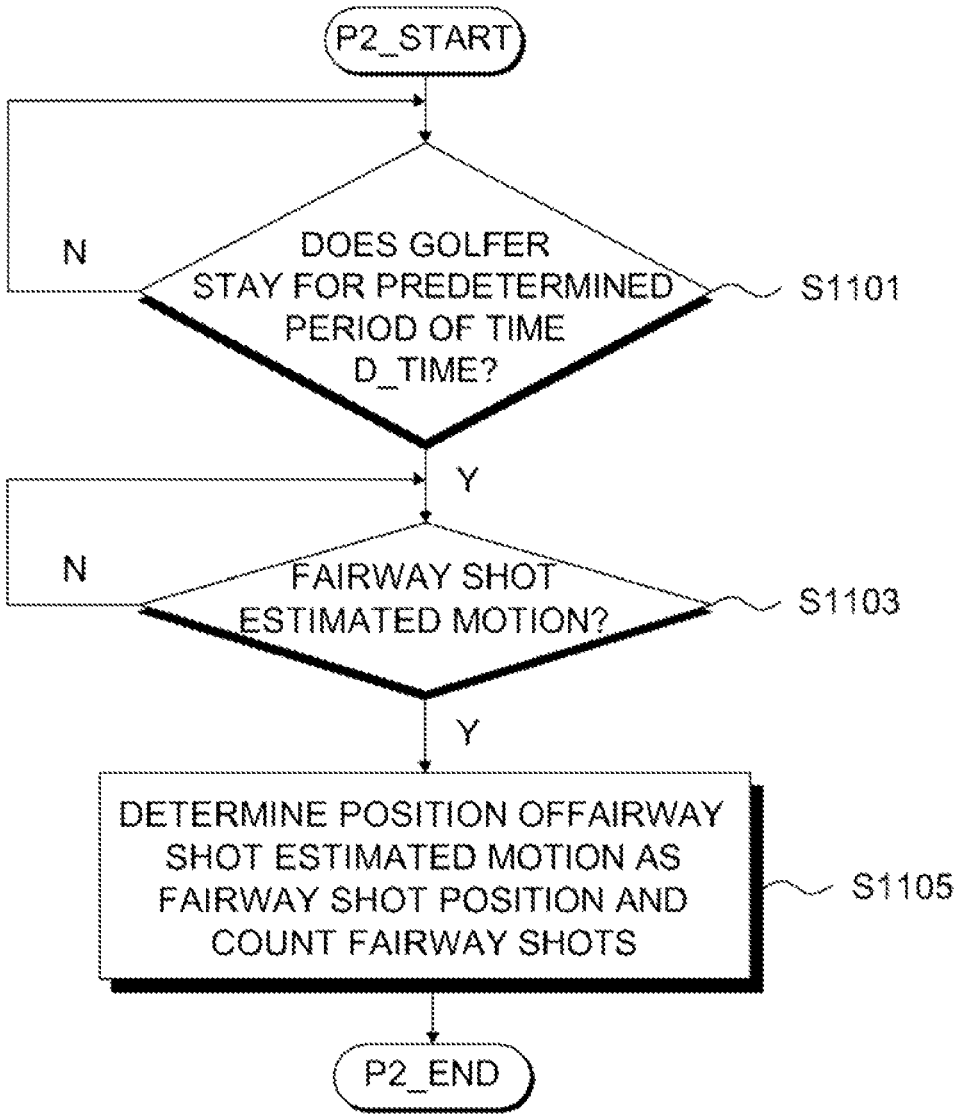
FIG. 11 is a flowchart of a method of determining whether a fairway shot is hit and determining a position of the fairway shot according to an exemplary embodiment of the present invention.

FIG. 11 is a flowchart of a method of determining whether a fairway shot is hit and to determining a position of the fairway shot according to an exemplary embodiment of the present invention.

Referring to FIG. 11, the management server 200 records a position of a fairway shot estimated motion as the fairway shot position and counts fairway shots (S1105) if a golfer stays in the fairway region for the predetermined period of time D_Time (S1101:YES), and there is a fairway shot estimated motion (for example, a waist motion).

For example, the "F_Time" is time necessary for hitting the fairway shot in the fairway region and may be determined by experience, for example, more than 5 seconds.

As a modification, if a golfer stays in a fairway region for the predetermined period of time D_Time, and there is a fairway shot estimated motion and fairway shot estimated sound, the management server 200 records a golfer position where the golfer stays for the predetermined period of time D_Time or when there is the fairway shot estimated motion or when there is the fairway shot estimated sound as a fairway shot position and counts fairway shots.

As another modification, if the golfer stays in the fairway region for the predetermined period of time D_Time, and there is the fairway shot estimated sound, the management server 200 records a golfer position where the golfer stays for the predetermined period of time D_Time or when there is the fairway shot estimated sound as the fairway shot position and counts fairway shots.

As another modification, if there is the fairway shot estimated sound in the fairway region, the management server 200 records a golfer position when there is the fairway shot estimated sound as the fairway shot position and counts fairway shots.

Figure 12:
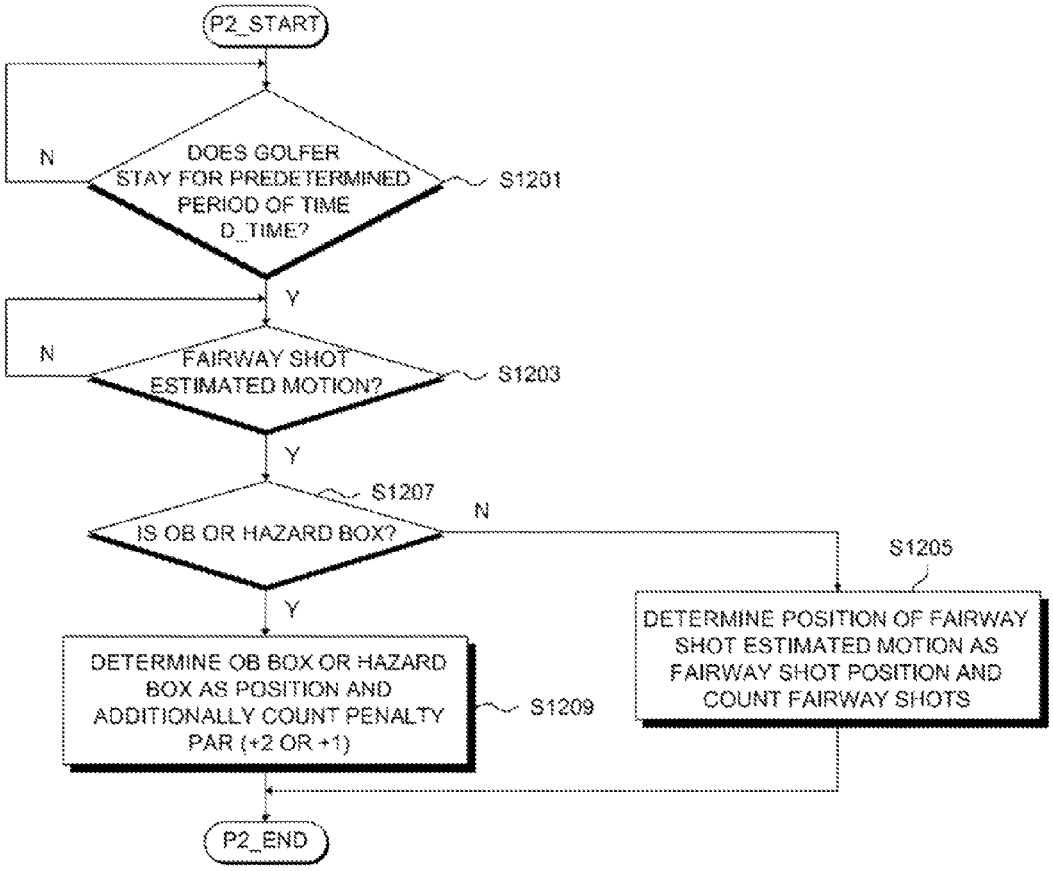
FIG. 12 is a flowchart of a method of determining whether a fairway shot is hit and determining a position of the fairway shot according to another exemplary embodiment of the present invention.

FIG. 12 is a flowchart of a method of determining whether a fairway shot is hit and determining a position of the fairway shot according to another exemplary embodiment of the present invention.

FIG. 12 is almost similar to FIG. 11 and is different from FIG. 11 in that if a position of a golfer is included in an out of bounds (OB) or hazard box region (S1207), a penalty par of +2 or +1 is added (S1209). The management server 200 is already informed of a position of the hazard box (included in hole information), and thus when the golfer hits a golf shot in the hazard box, if there is fairway shot estimated sound or if there is a fairway shot estimated motion, a penalty par of +1 is added when fairway shots are counted. A process similar to the process above is possible with respect to the OB box. However, the penalty par (+2) will be automatically counted only in a golf resort in which the OB box is separately established like the hazard box.

Figure 13:
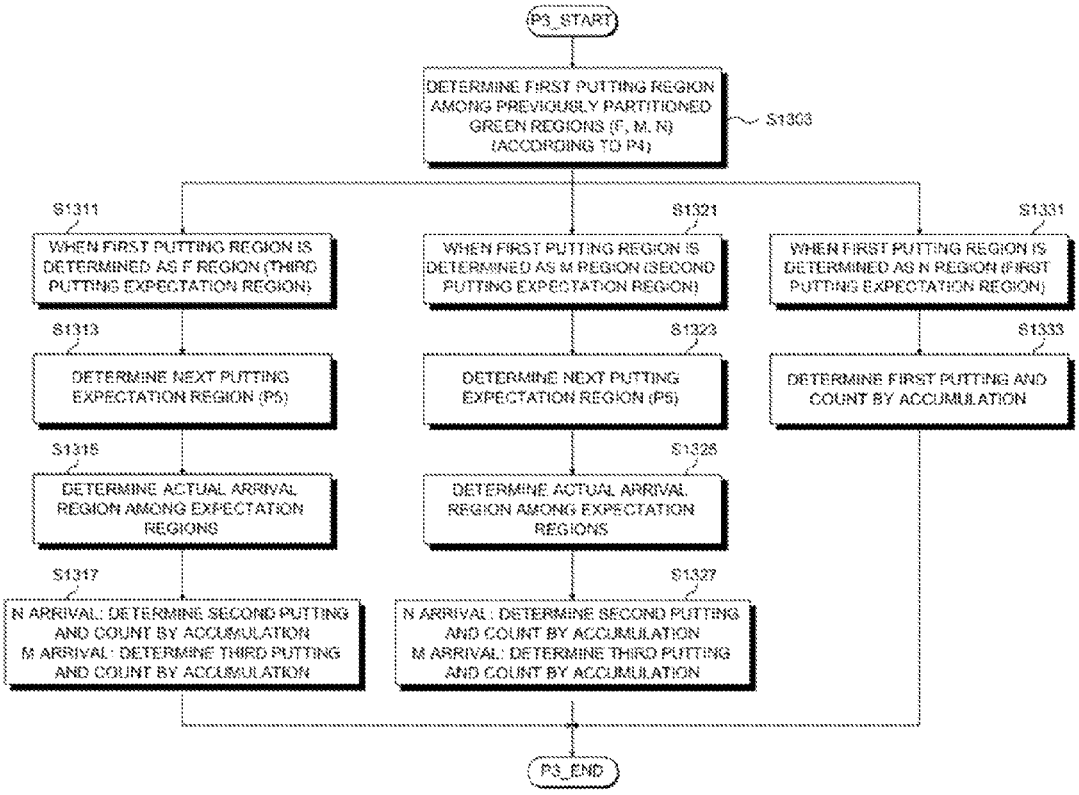
FIG. 13 is a flowchart of a method of determining whether a putting shot is hit and determining a position of the putting shot according to an exemplary embodiment of the present invention.

FIG. 13 is a flowchart of a method of determining whether a putting shot is hit and determining a position of the putting shot according to an exemplary embodiment of the present invention.

Referring to FIG. 13, as described above, it is assumed that partitioned green regions are 3 (the F region, the M region, and N region), and first default putting shots thereof are +3, +2, and +1.

If the management server 200 determines that a golfer is in a green region, the management server 200 determines a base region of the three partitioned green regions to which a first putting position belongs by using a process P4 (S1303). Process P4 determines the first putting position and determines base regions to which the first putting position belongs. This will be described in detail with reference to FIGS. 16 and 17.

After the management server 200 determines the base region to which the first putting position belongs, the management server 200 determines second putting expectation regions (S1311 through S1313 and S1321 through S1323) based on the base region to which the first putting position belongs and the first putting position, determines a region of the second putting expectation regions in which a second putting position is located (S1315 and S1325), and determines a second default putting number previously allocated to the second putting expectation region in which the second putting position is located as the total putting number (S1317 and S1327). Meanwhile, the management server 200 determines the total putting number as +1 when the first putting position is located in the N region (S1331 through S1333).

S1313 and S1323 are determined by process P5 that will be described in detail with reference to FIGS. 18 through 20.

S1315 and S1303 include a process of determining a region of the green region in which a ball to be put is located. The management server 200 determines the region of the green region in which the ball to be put is located, and determines a position of the ball to be put based on whether the putting shot counting condition described above is satisfied. That is, the management server 200 determines the position of the ball to be put as a position satisfying the putting shot counting condition.

S1317 and S1327 will now be described.

S1317 is performed when the first putting position is in the F region, and determines a second default putting number allocated to a region where a golf ball actually arrives as a result of a first putting as the total putting number. For example, as a result of the first putting, if the golf ball arrives at the N region, the total putting number is determined as +2, and if the golf ball arrives at the M region, the total putting number is determined as +3. The second default putting number may be determined as ±1 to the first default putting number allocated to a corresponding region. However, the present invention is not limited thereto.

S1327 is performed when the first putting position is in the M region, and determines the second default putting number allocated to the region where the golf ball actually arrives as a result of the first putting as the total putting number. For example, as a result of the first putting, if the golf ball arrives at the N region, the total putting number is determined as +2, and if the golf ball arrives at the M region, the total putting number is determined as +3. The second default putting number may be determined as ±1 to the first default putting number allocated to a corresponding region as described above. However, the present invention is not limited thereto.

Figure 14:
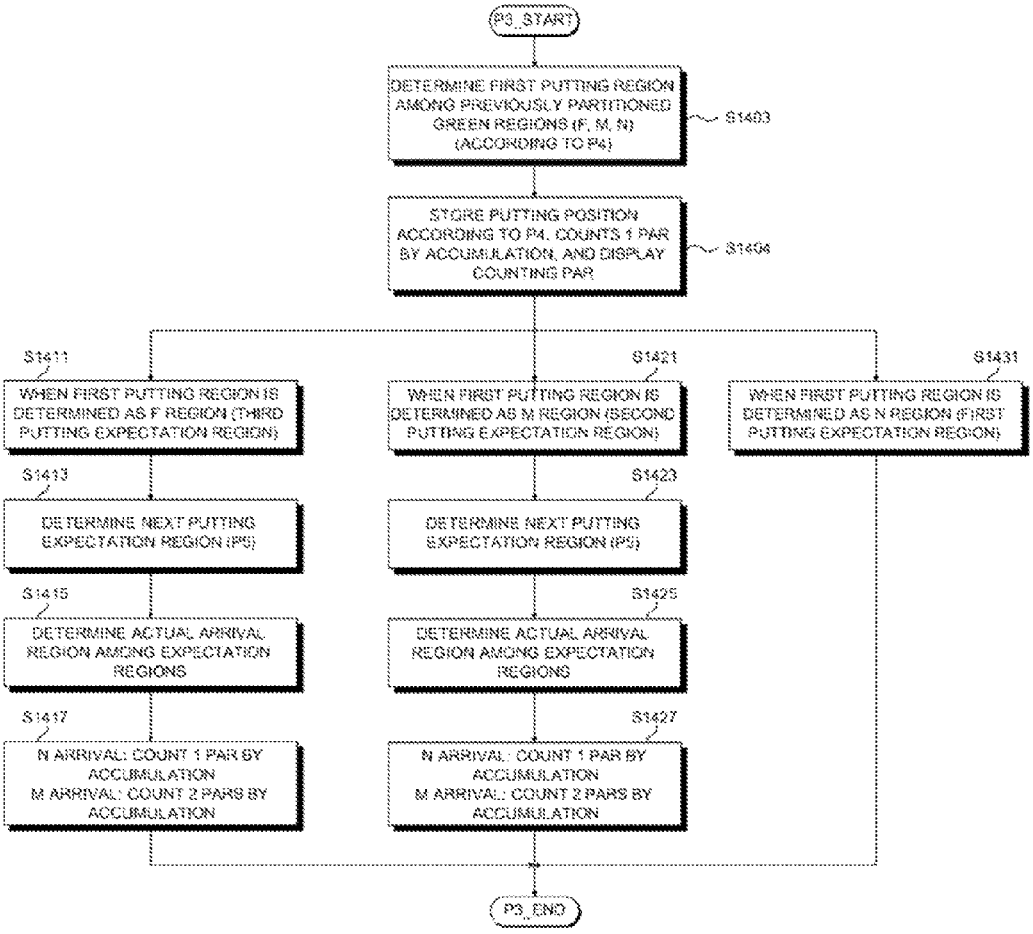
FIG. 14 is a flowchart of a method of determining whether a putting shot is hit and determining a position of the putting shot according to another exemplary embodiment of the present invention.

FIG. 14 is a flowchart of a method of determining whether a putting shot is hit and determining a position of the putting shot according to another exemplary embodiment of the present invention.

FIG. 14 is almost similar to the process of FIG. 13 and is different from FIG. 13 in that if the first putting position is determined (S1403), the management server 200 stores the first putting position, counts accumulated +1, transmits and displays the accumulated shot to the golf assistant terminal 300. According to an embodiment, the accumulated shot may be displayed on the golfer terminal 100*a* as described above. The subsequent process is the same as that of FIG. 13 and thus will be omitted here.

Figure 15:
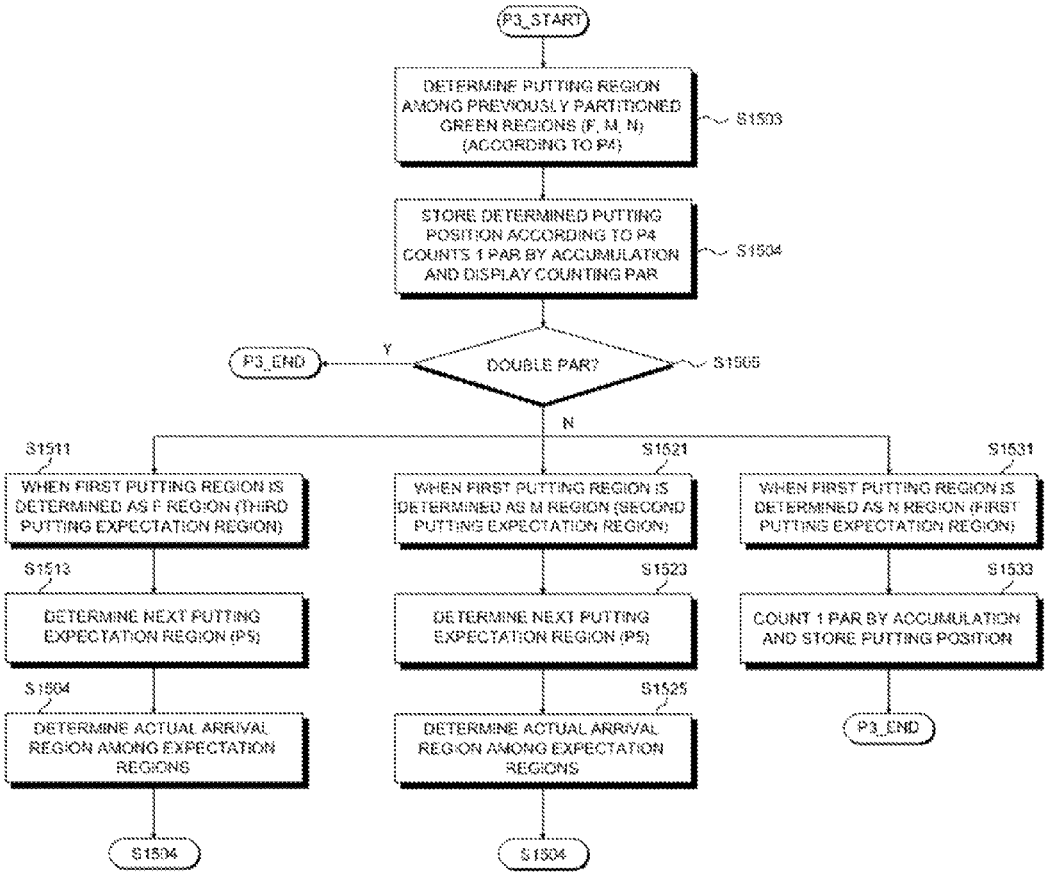
FIG. 15 is a flowchart of a method of determining whether a putting shot is hit and determining a position of the putting shot according to another exemplary embodiment of the present invention.

FIG. 15 is a flowchart of a method of determining whether a putting shot is hit and determining a position of the putting shot according to another exemplary embodiment of the present invention.

FIG. 15 is almost similar to the process of FIG. 14 and is different from FIG. 14 in that the management server 200 determines whether an accumulated par of a current hole is a double par, if the accumulated par of the current hole is the double par, and accumulates a par no longer in the current hole (S1505:YES). Generally, the double par is more than 6 par in a par 3 hole, more than 8 par in a par 4 hole, and more than 10 par in a par 5 hole. In the present embodiment, although it depends on a rule of a golf tournament, the double par is introduced as a reference that there is no meaning to accumulate shots. A function similar to the double par may be introduced.

Figure 16:
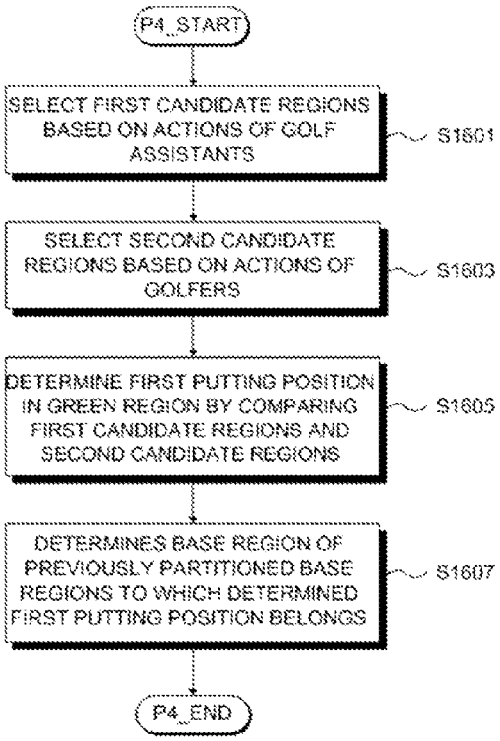
FIG. 16 is a flowchart of a sub process used in the methods of FIGS. 13 through 15 according to an exemplary embodiment of the present invention.

FIG. 16 is a flowchart of the sub process P4 used in the methods of FIGS. 13 through 15 according to an exemplary embodiment of the present invention.

The sub process P4 determines a first putting position and determines a base region to which the first putting position belongs.

Referring to FIG. 16, the management server 200 selects first candidate regions in which the first putting position is estimated to be located based on actions of golf assistants (S1601), selects second candidate regions in which the first putting position is estimated to be located based on actions of golfers (S1603), determines the first putting position by comparing the first candidate regions and the second candidate regions (S1605), and determines a base region of previously partitioned green regions to which the determined first putting position belongs (S1607).

The actions of golf assistants may be, for example, how many hour golf assistants do not move and stay in a region of green or a motion (i.e. a putting shot assistance estimated motion) estimated as an action assisting a putting shot, etc. Also, the actions of golfers may be, for example, how many hour golfers do not move and stay in a region of green or a motion (i.e. a putting shot estimated motion) or putting shot estimated sound estimated as an action hitting the putting shot, etc.

In this regard, S1601 and S1602 may be performed without a temporal sequence and may be simultaneously performed.

Figure 17:
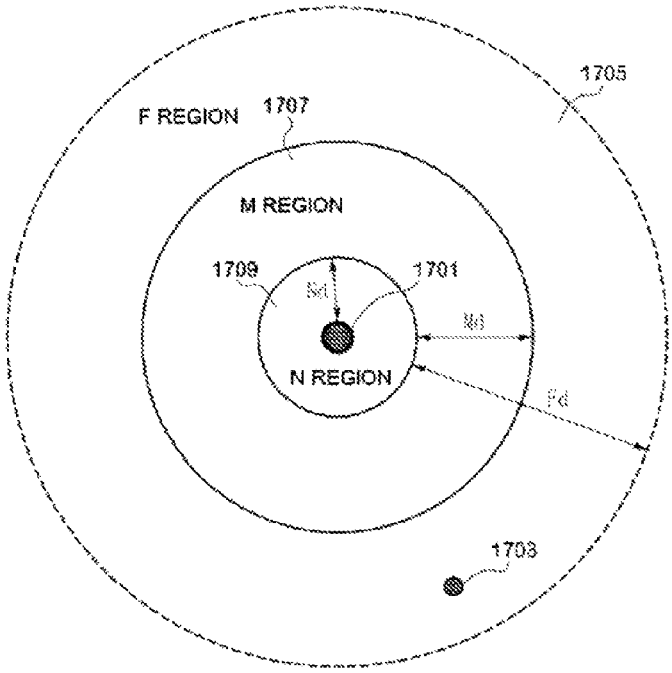
FIG. 17 is a diagram for explaining the sub process of FIG. 16.

FIG. 17 is a diagram for explaining the sub process P4 of FIG. 16.

Referring to FIG. 17, a green region is virtually partitioned into a predetermined number. Bases regions include an N region 1709, an M region 1707, an F region 1705, and a cup 1701. In the present embodiment, the N region 1709 is within a radius Nd[m] with respect to the cup 1701, the M region 1707 is between the radius Nd[m] and a radius Nd+Md[m] with respect to the cup 1701, and the F region 1705 is beyond the radius Nd+Md[m] with respect to the cup 1701. The virtually partitioned N, M, and F regions are not obtained by actually partition the green region but optionally partition the green region on a program. These regions are referred to as the base regions as described above.

A first putting position 1703 is located in the F region 1705, an outermost point line thereof is optional, and may be different according to a shape or size of the green region. Also, although the base regions are circular in FIG. 17, the base regions may be oval, and may have different shapes according to the shape of the green region. Meanwhile, a putting shot counting condition may be used to determine the base region where a golf ball 1703 is located as described above.

Information regarding the base regions of FIG. 17 is included in green region partition information of the management server 200. The management server 200 determines the first putting position 1703, and then determines the base region to which the first putting position 1703 belongs by using previously stored green region partition information.

Figure 18:
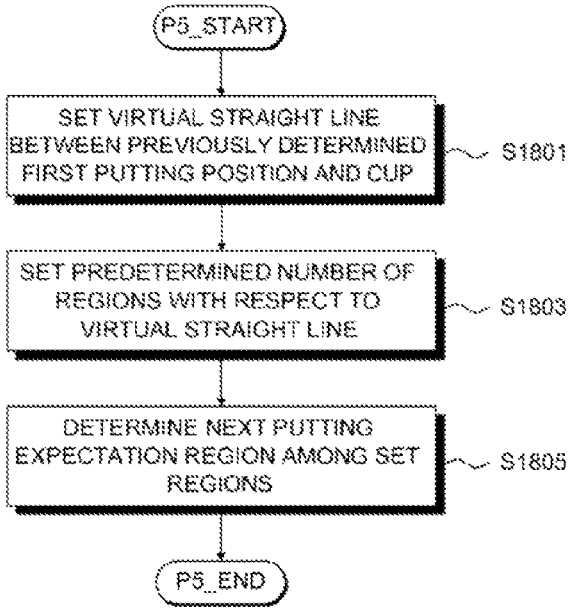
FIG. 18 is a flowchart of a sub process used in the methods of FIGS. 13 through 15 according to an exemplary embodiment of the present invention.
Figure 19:
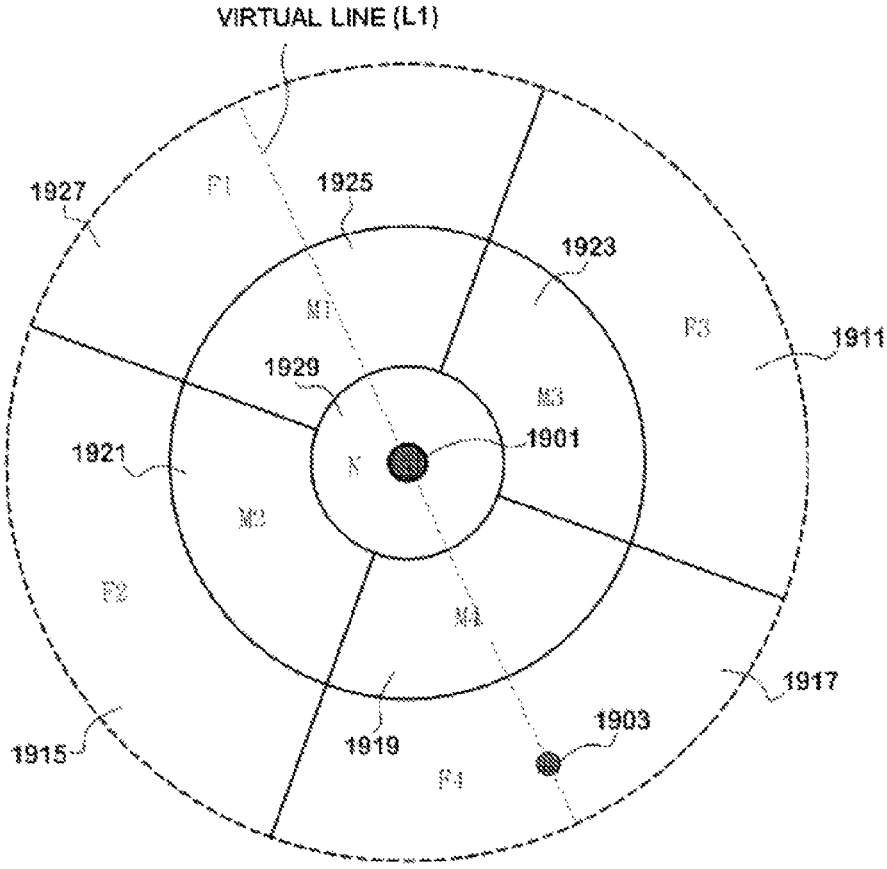
FIG. 19 is a diagram for explaining the sub process of FIG. 18.
Figure 20:
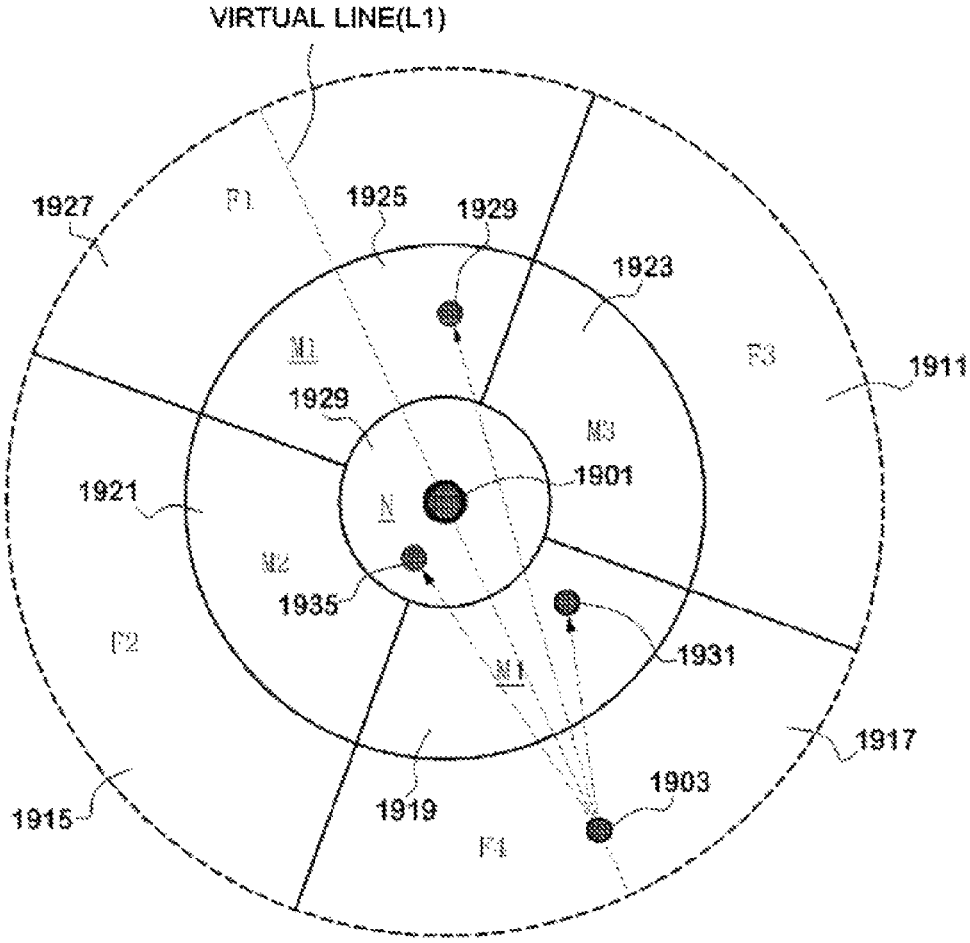
FIG. 20 is a diagram for explaining the sub process of FIG. 18.

FIG. 18 is a flowchart of a sub process P5 used in the methods of FIGS. 13 through 15 according to an exemplary embodiment of the present invention, FIG. 19 is a diagram for explaining the sub process P5 of FIG. 18, and FIG. 20 is a diagram for explaining the sub process P5 of FIG. 18.

FIGS. 18 through 20 are diagrams for explaining a process of selecting a second putting expectation region. The management server 200 sets a virtual straight line between a previously determined first putting position and a cup (S1801), sets a plurality of virtual regions with respect to the virtual straight line (S1803), and determines the second putting expectation region among the virtual regions (S1805).

A method of setting the virtual regions will be described with reference to FIG. 19.

Referring to FIG. 19, a virtual straight line between a first putting position 1903 and a cup 1901 is shown, and 9 virtual regions are set with respect to the virtual straight line. That is, the 9 virtual regions include regions F1 1927, F2 1915, F3 1911, to F4 1917, M1 1926, M2 1921, M3 1923, M4 1919, and N 1929. The 9 virtual regions are virtual and may be determined by experience.

For example, a golfer may do a putting along the virtual straight line from the first putting position 1917 to generally the cup. In this case, a golf ball may be located in one of the virtual regions described above. The virtual regions are used to select second putting expectation positions that will be described later.

An inclination or a geographical feature between the first putting position 1917 and the cup may differ for each hole, and thus the virtual straight lien may differ for each hole. The management server 200 has hole information regarding each hole and thus may set the virtual straight line in accordance with a feature of each hole.

A method of selecting the second putting expectation position will now be described with reference to FIG. 20.

If first putting is made along the virtual straight ling of FIG. 19, highly probable regions which belong to the second putting expectation region may be set as the regions M4 1919, N 1929, and M1 1929. The regions M4 1919, N 1929, and M1 1929 may be automatically determined by the management server 200. For example, regions contacting the virtual straight line may be set as the regions which belong to the second putting expectation region. However, the region F1 1927 is excluded from the second putting expectation region in the embodiment of FIG. 20, which is based on an experience considering that a probability that the golfer does the first putting in the region F4 1917 and returns back to the region F1 1927 is very low. According to an embodiment, the region F1 1927 may be included in the second putting expectation region.

Figure 23:
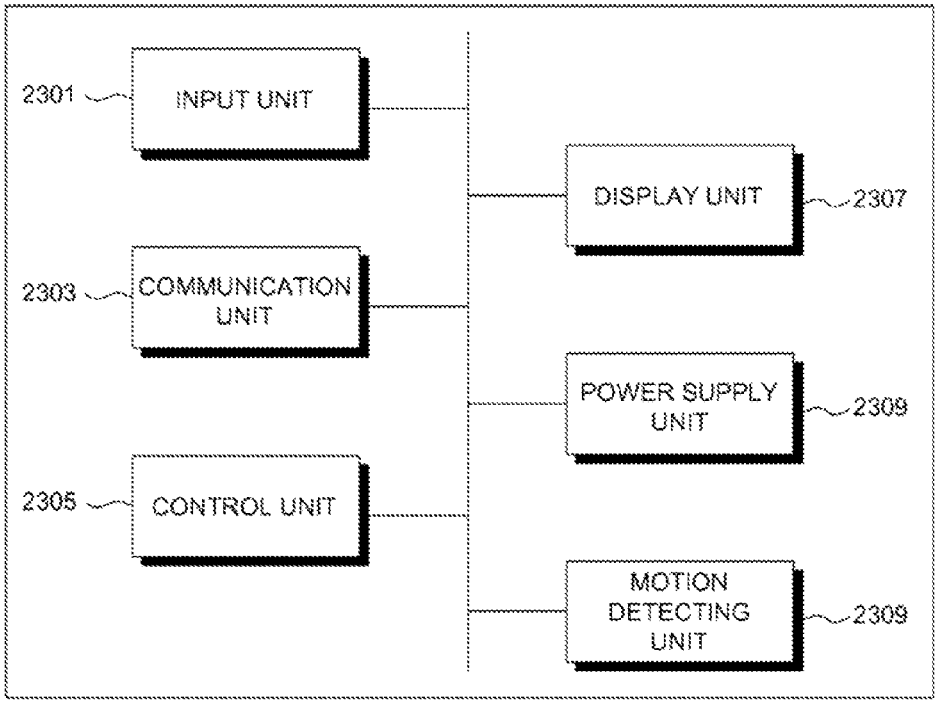
FIG. 23 is a block diagram of a golf assistant terminal according to an exemplary embodiment of the present invention.

FIG. 23 is a block diagram of a golf assistant terminal according to an exemplary embodiment of the present invention. The golf assistant terminal of FIG. 23 that additionally includes a motion detecting unit 2311 for detecting a motion of a golf assistant is just different from the golf assistant terminal of FIG. 2. The motion detecting unit 2311 may detect an up and down motion of the golf assistant. A control unit 2305 transmits a motion detection result obtained by the motion detecting unit 2311 to the management server 200 through a communication unit 2303.

Figure 24:
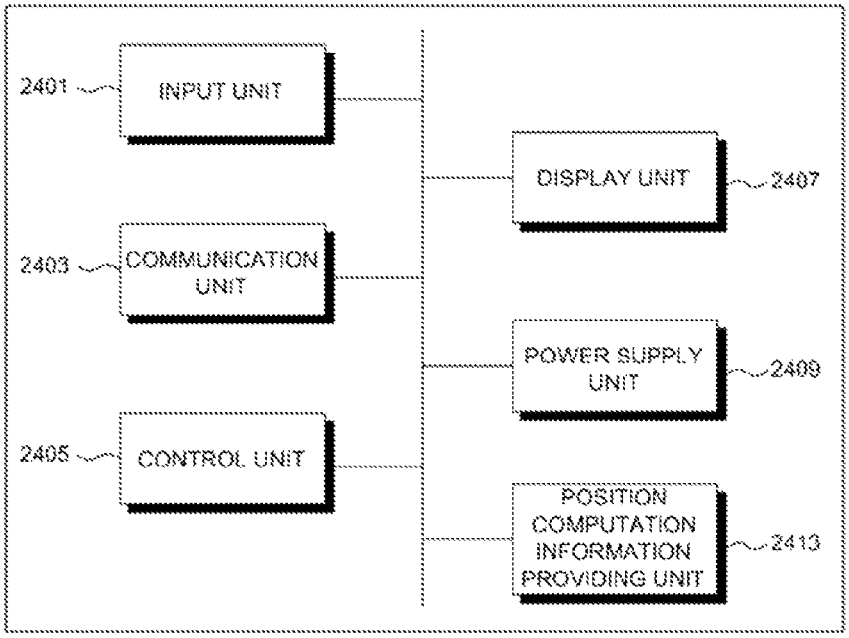
FIG. 24 is a block diagram of a golf assistant terminal according to another exemplary embodiment of the present invention.

FIG. 24 is a block diagram of a golf assistant terminal according to another exemplary embodiment of the present invention.

The golf assistant terminal of FIG. 24 which additionally includes a position computation information providing unit 2413 for computing a location of a golf assistant is different from the golf assistant terminal of FIG. 2. The position computation information providing unit 2413 receives, for example, position computation information from a GNSS, and provides a necessary unit (for example, the management server 200) with the position information. A control unit 2405 transmits the position computation information provided by the position computation information providing unit 2413 to the management server 200 through a communication unit 2403.

Figure 25:
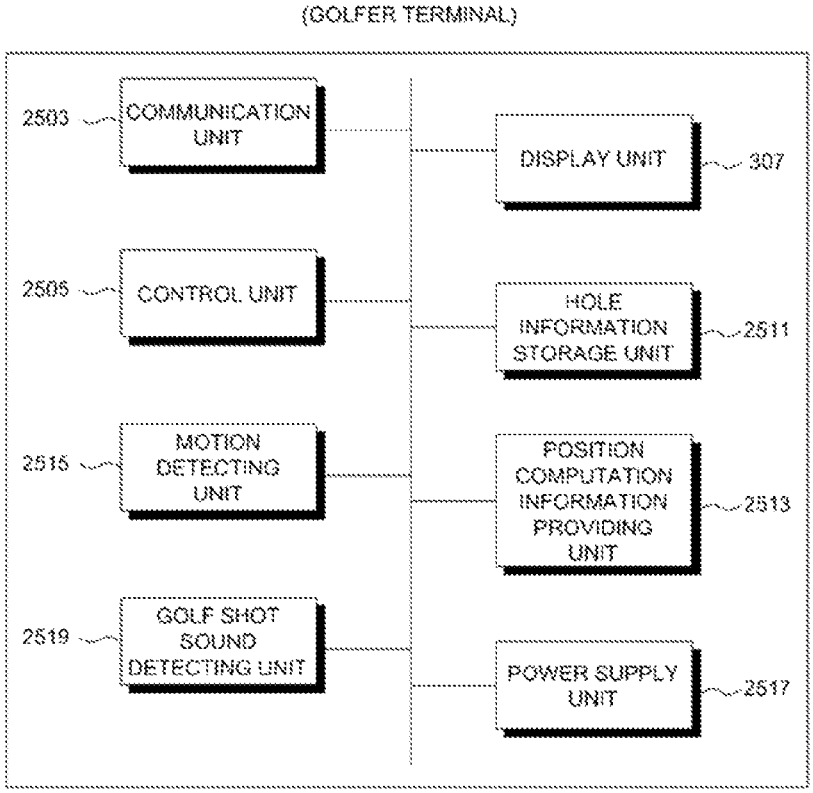
FIG. 25 is a block diagram of a golfer terminal according to another exemplary embodiment of the present invention.

FIG. 25 is a block diagram of a golfer terminal according to another exemplary embodiment of the present invention.

The golfer terminal of FIG. 25 which additionally includes a golf shot sound detecting unit 2519 for detecting sound that is estimated to be generated when a golfer hits a golf shot is different from the golfer terminal of FIG. 3. The golf shot sound detecting unit 2519 may detect sound, such as "bang" generated from a shot, "OK", "nice putting" generated from putting, etc. A control unit 2505 transmits information regarding the sound detected by the golf shot sound detecting unit 2519.

According to an embodiment of the present invention, the golfer terminal 100*a* may include a key used to open or close a locker. Generally, a club house of a golf resort provides a golfer with a locker used to keep belongings and a key of the locker. The key of the locker is easily lost. If the key of the locker is installed in the golfer terminal 100*a* according to an embodiment of the present invention, the key of the locket is easily kept. The key of the locker may be a key in a physical shape or a digital key. If the key of the locker is the digital key, a size of the golfer terminal 100*a* may not increase, and the digital key may be easily carrying.

If the golfer terminal 100*a* including the key of the locker, for example, touches the locker in a contact way or in a non-contact way, a door of the locker is opened. If the door of the locker is closed, the locker is automatically locked.

Differently, only when. for example, a password is input into the key of the locker installed in the golfer terminal 100*a*, and the password is correct, the door of the locker may be opened if the golfer terminal 100*a* including the key of the locker touches the locker in a contact way or in a non-contact way.

Figure 29:
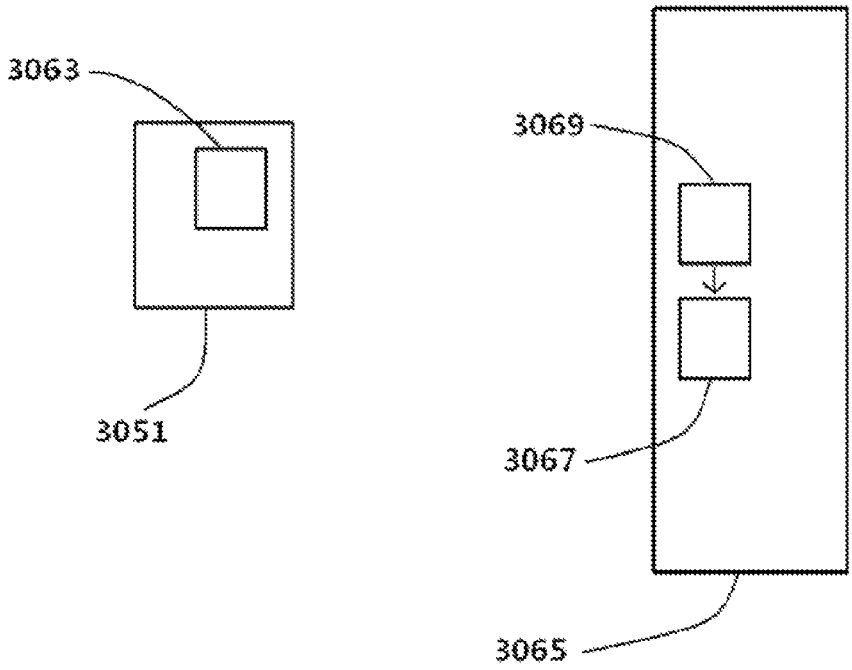
FIG. 29 is a block diagram of a golfer terminal including a digital locker key according to an exemplary embodiment of the present invention.

FIG. 29 is a block diagram of a golfer terminal 3051 including a digital locker key 3063 according to an exemplary embodiment of the present invention.

The golfer terminal 3051 according to the present invention includes the digital locker key 3063. A locker 3065 includes a door opening/closing unit 3067 and a control unit 3069 for controlling an opening and closing operation of the door opening/closing unit 3067 according to a correlation between the digital locker key 3063 and the locker 3065.

The digital locker key 3063 transmits locker control information to the control unit 3069 via a direct communication with the control unit 3069 or via a communication with a communication unit (not shown). The control unit 3069 performs the opening and closing operation based on the locker control information. The locker control information may include a password and inherent ID information of the locker 3065.

According to another embodiment, the golfer terminal 3051 and the locker 3065 may directly contact each other to perform the opening and closing operation.

Figure 30:
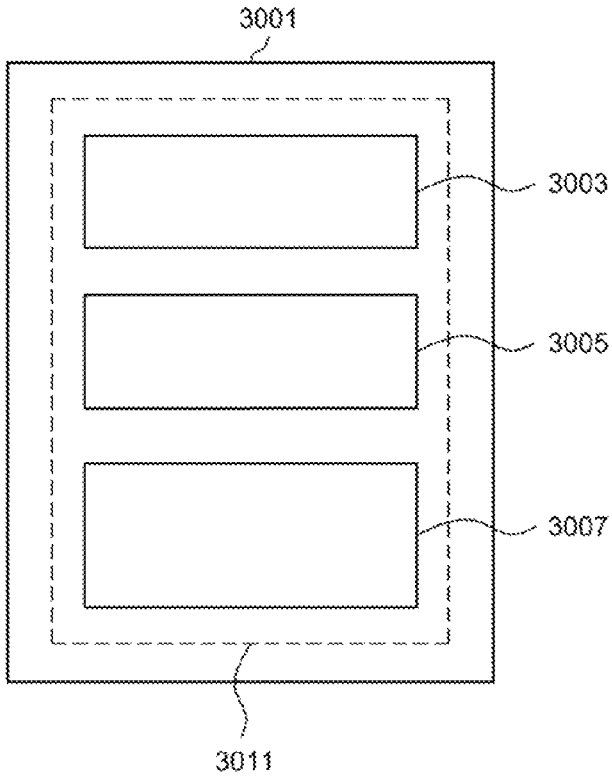
FIG. 30 is a diagram of a user interface unit of a golfer terminal according to another exemplary embodiment of the present invention.

FIG. 30 is a diagram of a user interface unit of a golfer terminal 3001 according to another exemplary embodiment of the present invention.

The golfer terminal 3001 according to an embodiment of the present invention has a plurality of operating modes.

According to an embodiment of the present invention, the golfer terminal 3001 has three operating modes.

The management server 200 may control the golfer terminal 3001 to operate in the three operating modes according to a position or a status of the golfer terminal 3001.

Referring to FIG. 30, the golfer terminal 3001 includes three display regions. The three display regions display different types of information according to the operating modes of the golfer terminal 3001. The display information may be transmitted from the management server 200 or may be previously stored therein. Although the three display regions are shown in FIG. 30, this is merely exemplary, and two or less display regions or four or more display regions may be included in the golfer terminal 3001.

The operating modes of the golfer terminal 3001 may be switched if there is a notification or a command indicating a switch of the operating modes of the management server 200. The management server 200 performs an operation of automatically switching proper operating modes based on a location of the golfer terminal 3001 or a tournament status of a golfer.

For example, the golfer terminal 3001 may operate in a first operating mode, a second operating mode, and a third operating mode. The management server 200 may control the golfer terminal 3001 to operate in the first operating mode before a tournament starts, in the second operating mode until the tournament ends, and in the third operating mode after the tournament ends.

Figure 31:
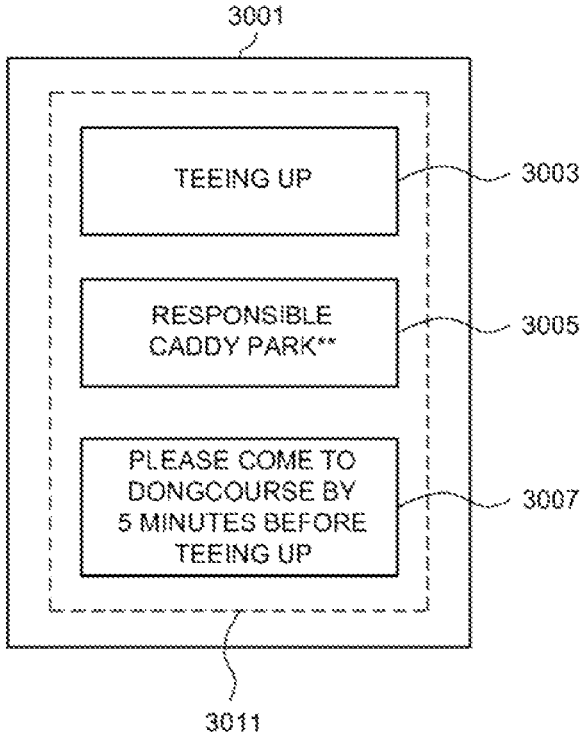
FIG. 31 illustrates an operation of a golfer terminal in a first operating mode according to an exemplary embodiment of the present invention.
Figure 32:
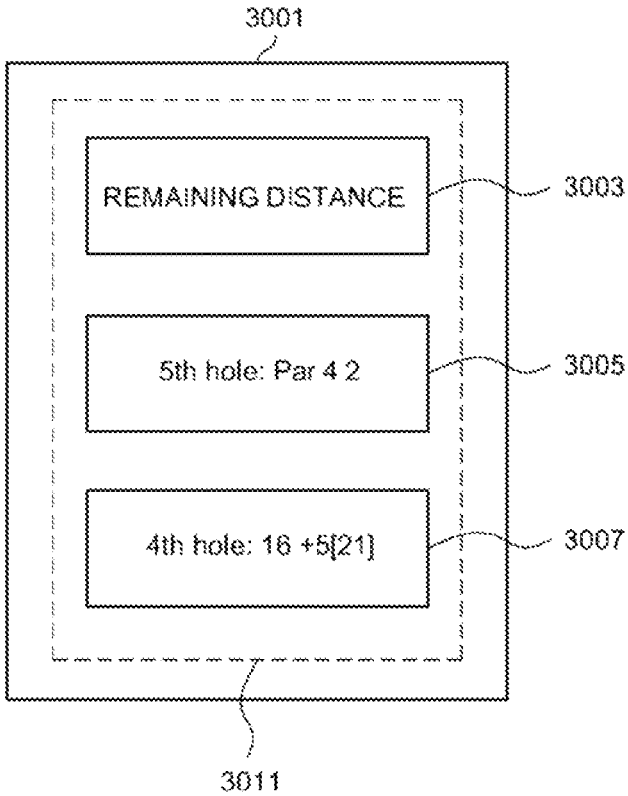
FIG. 32 illustrates an operation of a golfer terminal in a second operating mode according to an exemplary embodiment of the present invention.
Figure 33:
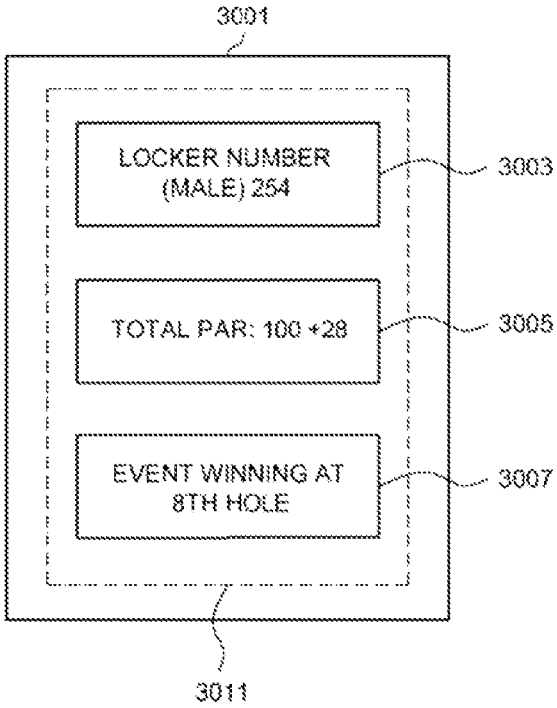
FIG. 33 illustrates an operation of a golfer terminal in a third operating mode according to an exemplary embodiment of the present invention.

FIG. 31 illustrates an operation of the golfer terminal 3001 in a first operating mode according to an exemplary embodiment of the present invention. FIG. 32 illustrates an operation of the golfer terminal 3001 in a second operating mode according to an exemplary embodiment of the present invention. FIG. 33 illustrates an operation of the golfer terminal 3001 in a third operating mode according to an exemplary embodiment of the present invention.

Each operating mode will now be described with reference to FIGS. 31, 32, and 33.

The management server 200 determines an operating mode based on a current location of a golfer, and, if the golfer has not arrived at a tournament ground or is located in a club house, controls the golfer terminal 3001 to operate in the first operating mode.

Referring to FIG. 31, teeing up time, a name of a golf assistant, and information regarding a tournament start is displayed in the first operating mode. The information displayed in the first operating mode is informed of the golfer before the tournament starts, and is not limited thereto and may include other useful information.

If the golfer has arrived at the tournament ground or is moving to start the tournament, the management server 200 may control the golfer terminal 3001 to operate in the second operating mode. For example, if the golfer arrives at or is moving to a first hole, the management server 200 transmits an operating mode switch message indicating that the golfer terminal 3001 operates in the second operating mode to the golfer terminal 3001. The gofer terminal 3001 receives the operating mode switch message to switch the second operating mode and operates in the second operating mode.

Referring to FIG. 32, a remaining distance, an accumulation par of a current hole, and an accumulation par by a previous hole are displayed in the second operating mode.

The remaining distance may be information received from the management server 200 in real time. The accumulation par of the current hole may be also information received from the management server 200 in real time. Although the accumulation par by the previous hole may be information received from the management server 200, if the golfer terminal 3001 separately stores the accumulation par by the previous hole, a previously stored "accumulation par by the previous hole" may be displayed.

Information denoting reference numeral 3007 indicates 16 par by a fourth hole and 5 over par, and thus the total accumulation par is 21 par.

Information denoting reference numeral 3005 indicates a par 4 and 2 shots in a fifth hole.

If the tournament ends, i.e. if the golfer leaves a final hole or arrives at near the club house, the management server 200 transmits a command to switch the third operating mode to the golfer terminal 3001. The golfer terminal 3001 then switches to the third operating mode, and displays information defined in the third operating mode.

FIG. 33 illustrates information displayed on the golfer terminal 3001 in the third operating mode. Referring to FIG. 33, a locker number is [male]254, the total par is 100, and 28 is over par, and an event wins at an eighth hole.

The event can win automatically or manually. For example, if an event is set that a set of golf balls is given to a golfer as a present when the golfer hits a ball in a driver shot to a specific point of a fairway region in the eight hole, the management server 200 may automatically determine whether the golfer wins the event in the eighth hole. This is because the management server 200 according to the present invention can be informed of a shot position of the golfer.

In addition, after the tournament ends, information necessary for the golfer may be displayed.

In this way, the management server 200 may provide the golfer with various types of information according to the tournament process.

Although the golfer terminal 3001 operates in the three operating modes, the golfer terminal 3001 can operate in two or less operating modes or four or more operating modes. Also, although the golfer terminal 3001 switches the operating modes under control of the management server 200, the golfer terminal 3001 can switches the operating modes, for example, according to an instruction of a golf assistant or the golfer.

An operation of switching the three operating modes of the golfer terminal 3001 according to the instruction of the golf assistant will now be described.

To this end, the golf assistant terminal 300 further includes a use interface unit to receive an operating mode switch command from the golf assistant. The user interface unit may be, for example, a button or a touch pad, but the present invention is not limited thereto. The golfer terminal 3001 initially operates in the first operating mode. If the golf assistant transmits a command to switch the first operating mode to the second operating mode by using the golf assistant terminal 300 at the time of a tournament start, the command may be directly transmitted to the management server 200 or the golfer terminal 3001. If the command is directly transmitted to the management server 200, the management server 200 transmits the command to switch the first operating mode to the second operating mode to the golfer terminal 3001 and information necessary for the second operating mode as well. Meanwhile, if the command is directly transmitted to the golfer terminal 3001 from the golf assistant terminal 300, the management server 200 must be informed of a switch of the operating modes of the golfer terminal 300. The golf assistant terminal 300 may transmit a notification indicating the switch of the operating modes of the golfer terminal 300 to the management server 200 or the golfer terminal 3001 may transmit the notification indicating the switch of the operating modes thereof to the management server 200.

Meanwhile, the golfer terminal 3001 is switched to the second operating mode according to the operation mode switch command. The management server 200 is informed of the operating mode of the golfer terminal 3001 (as described above, the management server 200 is informed of the operating mode of the golfer terminal 100 by receiving the switch command or a message indicating the switch command is sent from the golf assistant terminal 300, and transmits the information necessary for the second operating mode to the golfer terminal 3001.

Thereafter, if the tournament ends, the golf assistant may send a command to switch the second operating mode to the third operating mode by using the golf assistant terminal 300. Thereafter, in the same manner as switching the first operating mode to the second operating mode, the golfer terminal 3001 is switched to the third operating mode, and the management server 200 transmits information necessary for the third operating mode.

Differently, the operating modes of the golfer terminal 3001 can be switched according to an instruction of the golfer. That is, the golfer terminal 3001 may further include a user interface unit for switching the operating modes such as a button, a switch, and a touch pad, so that the operating modes can be switched through the user interface unit. For example, if the golfer receives a first golf terminal, the golfer terminal operates in the first operating mode, then, the operating mode switch command is received from the golfer, the golfer terminal operates in the second operating mode, and then, after the tournament ends, if the operating mode switch command is received from the golfer, the golfer terminal operates in the third operating mode.

Meanwhile, in the embodiments described above, although the management server 200 transmits the information necessary for each operating mode, the information displayed in the first operating mode and the information displayed in the third operating mode may be previously stored in the golfer terminal 3001. For example, if a teeing up time, a responsible caddy, a locker number, a locker number, etc. are initially stored in the golfer terminal 3001, no information cannot be transmitted from the management server 200.

In the embodiments described above, although the management server 200 calculates a par in real time and records a location, a function of the management server 200 can be integrated into the caddy terminal 300 as occasions demand.

Differently, a terminal may be further installed in a moving car (what is called, a "cart") for moving golfers. All functions of a golf assistant terminal can be implemented in the terminal. Although the golf assistant corrects and acknowledges pars of golfers through the golf assistant terminal, the golf assistant can correct and acknowledge pars of golfers through the terminal installed in the cart. Also, the terminal further installed in the cart may display a map of all holes to be played and current positions of golfers on the map, and distances from main points to a hazard or a bunker. Also, the terminal further installed in the cart may have a function of printing an accumulation par of golfers for each hole.

The present invention can be utilized for golf relay broadcasting. That is, according to the present invention, since the number of shots and traces of a golfer can be automatically stored and managed in real time, data accumulated in real time is connected to a golf relay broadcasting system and thus a viewer can view a golf tournament with interest. For example, the golf relay broadcasting system can broadcast a screen showing a golf shot actually hit by a golfer and a sub screen showing a current position of the golfer who currently hits the golf shot together, and thus the viewer can view the golf tournament three-dimensionally with more interest.

Figure 34:
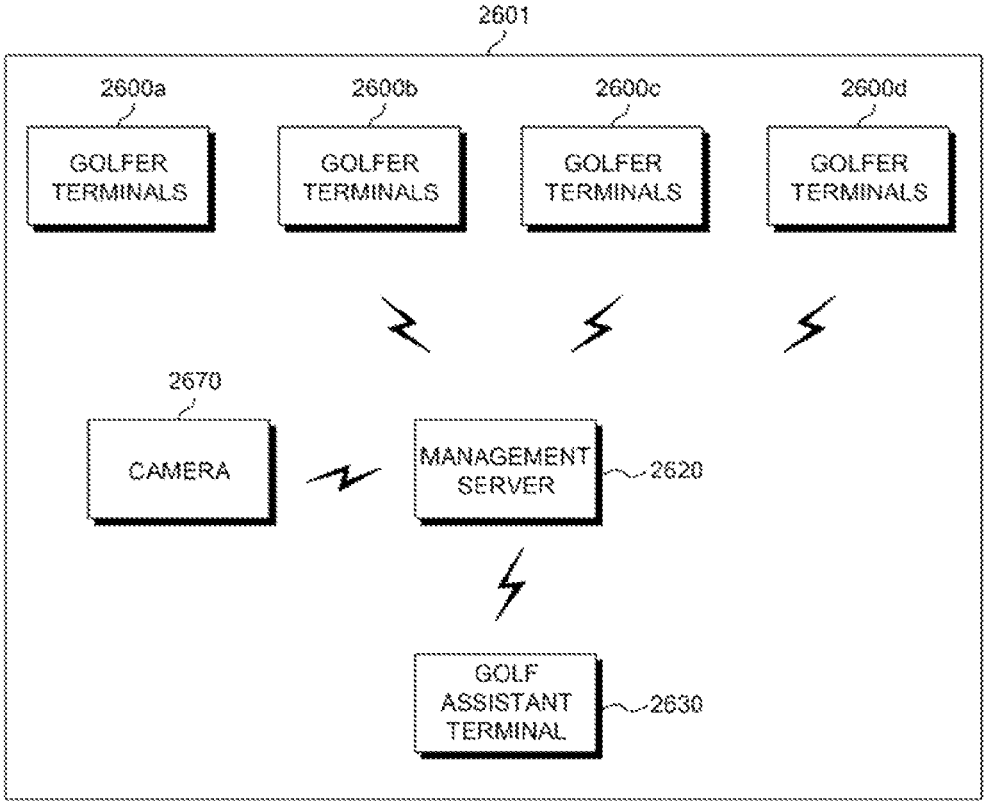
FIG. 34 is a block diagram of an intelligent real-time golf tournament management system according to another exemplary embodiment of the present invention.

FIG. 34 is a block diagram of an intelligent real-time golf tournament management system 2631 according to another exemplary embodiment of the present invention.

Referring to FIG. 34, the intelligent real-time golf tournament management system 2631 includes golfer terminals 2600*a*, 2600*b*, 2600*c*, and 2600*d*, a management server 2620, a golf assistant terminal 2630, and a camera 2670.

The golfer terminals 2600*a*, 2600*b*, 2600*c*, and 2600*d*, the management server 2620, and the golf assistant terminal 2630 may be respectively implemented to wholly or partially include the functions described above.

The management server 2620 has the following additional functions relating to the camera 2670.

The camera 2670 is disposed at a specific position of a golf ground, and may capture a shot motion of a golfer. For example, the camera 2670 may be disposed at one of a driver shot region, a fairway shot region, and a green region, capture the shot motion of the golfer, and transmit the captured shot motion to the management server 2620. The camera 2670 may not capture the shot motion of the golfer every time in view of a storage capacity of the management server 2620 and may capture the shot motion of the golfer whenever the golfer actually does the shot motion.

Capturing of a driver shot motion when the golfer is located in the driver shot region will be described.

The management server 2620 may determine a golfer to enter the driver shot region. If the golfer enters the driver shot region, the management server 2620 may send a command to the camera 2670 to capture a motion of the golfer. The camera 2670 captures the motion of the golfer according to the command to resume capturing. If the management server 2620 determines that the golfer leaves the driver shot region or finished the driver shot motion, the management server 2620 transmits a command to stop capturing to the camera 2670. The camera 2670 may stop capturing according to the command.

The camera 2670 may transmit capturing information to the management server 2620. The camera 2670 may also transmit the capturing information to the management server 2620 in real time. The camera 2670 may transmit the capturing information to the management server 2620 by wireless or wired and by using an intermediate medium.

A capturing time of the camera 2670 may be adjusted by the management server 2620. For example, although the management server 2670 may send the command to resume capturing to the camera 2670 at the time when the golfer enters the driver shot region, the management server 2670 may determine whether there is a driver shot preparatory motion, and send the to resume capturing to the camera 2670 at the time when the management server 2620 determined that there is the driver shot preparatory motion. A time for sending the command to stop capturing may be also appropriately adjusted.

The management server 2620 may store the shot motion of the golfer by appropriately adjusting the time for sending the command to resume capturing and the time for sending the command to stop capturing to the camera 2670. If the capturing information received from the camera 2670 includes unnecessary information excluding the shot motion of the golfer, the management server 2620 may delete the unnecessary information and the shot motion of the golfer only. As occasions demand, since the driver shot preparatory motion of the golfer may be useful to the golfer, the capturing information may include the driver shot preparatory motion of the golfer.

Since the management server 2620 can identify a golfer located in a current driver shot region and accurately determine a time when the shot motion is made, the management server 2620 may store an action of the golfer during a predetermined of period before and after the time (for example, t1) when the shot motion is made.

Accordingly, the management server 2620 may provide all tournament grounds with the shot motion in video without a burden of the storage capacity. This is possible for each hole, and a putting and a driver shot as well are possible. A plurality of cameras 2670 may be necessary for capturing a putting motion or a fairway shot motion unlike the driver shot motion.

Figure 35:
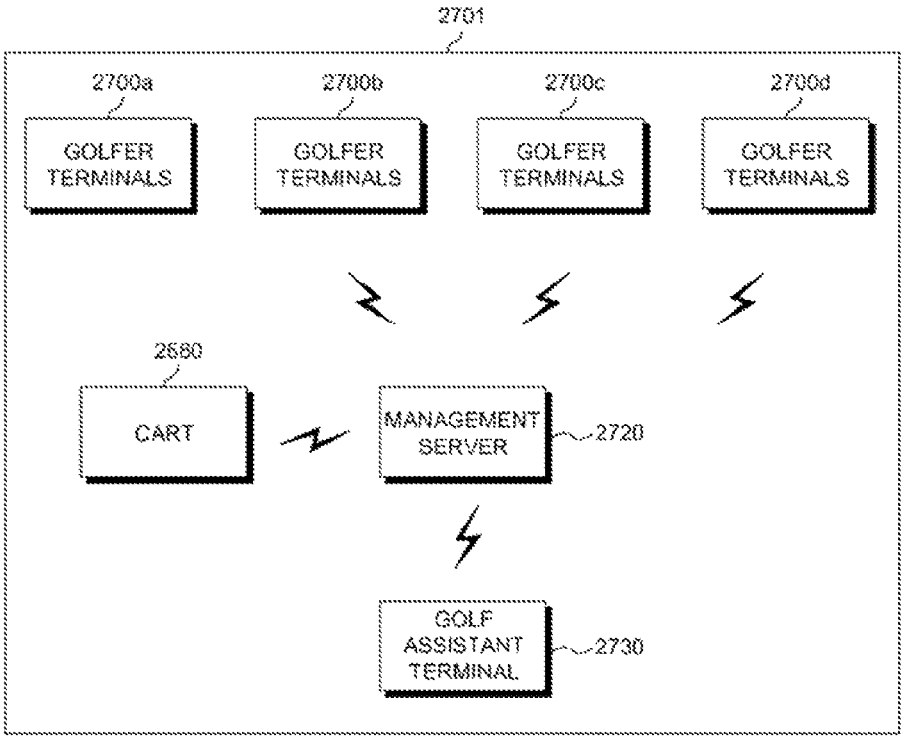
FIG. 35 is a block diagram of an intelligent real-time golf tournament management system according to another exemplary embodiment of the present invention.

FIG. 35 is a block diagram of an intelligent real-time golf tournament management system 2731 according to another exemplary embodiment of the present invention.

Referring to FIG. 35, the intelligent real-time golf tournament management system 2731 of the present embodiment includes golfer terminals 2700*a*, 2700*b*, 2700*c*, and 2700*d*, a management server 2720, a golf assistant terminal 2730, and a cart 2780.

The golfer terminals 2700*a*, 2700*b*, 2700*c*, and 2700*d*, the management server 2720, and the golf assistant terminal 2730 may be respectively implemented to wholly or partially include the functions described above. The cart 2780 performs a function of transporting a golfer or a golf assistant or a golf club.

The management server 2720 has the following additional functions relating to the cart 2780.

The management server 2720 may control an operation of the cart 2780. To this end, the cart 2780 may separately include a position information computing unit. The position information computing unit is a functional module for computing or obtaining position information such as a GNSS receiver or a tag-reader system described above.

The management server 2720 may receive the position information computing unit of the cart 2780, and determine a current position of the cart 2780. Since the management server 2720 can determine positions of the golfer and the golf assistant, the management server 2720 can move or stop the cart 2780 according to the positions of the golfer and the golf assistant. Accordingly, the golfer and the golf assistant can actively play a tournament, and the management server 2720 can determine that the golfer can personally drive the cart 2780. In this case, the management server 2720 can control the cart 2780 not to operate.

As described above, the management server 2720 can control the operation of the cart 2780 since the management server 2720 can determine positions of golfers and golf assistants in real time. Additionally, the management server 2720 can control the cart 2780 not to move if there is a person before the cart 2780.

In order for the management server 2720 to control the can 2780, the cart 2780 may include the position information computing unit as described above, a communication unit for transmitting the position information provided by the position to information computing unit to the management server 2720, a cart driving unit, and a control unit for controlling the cart driving unit. The management server 2720 and the cart 2780 can communicate each other wirelessly, directly, or via an intermediate medium device.

An additional function of the management server 200 according to the present invention will now be described with reference to FIGS. 1 and 5.

The management server 200 may store event information in addition to the information shown in FIG. 5. The event information provides a specific event if the specific event occurs in a specific region.

For example, if a driver shot ball is located at a point a of a green region in a second hole, providing of a set of golf balls to a corresponding golfer may be the event information. The management server 200 compares previously stored event information with a real time position of a golfer and a trace of a shot position, thereby automatically determining whether the golfer wins an event. The management server 200 may inform the golfer of winning the event in real time. For example, the management server 200 may use a cellular phone of the golfer or a terminal of the golf assistant.

That is, the management server 200 may automatically determine whether the golfer wins the event that is decided according to the real time position of the golfer, the shot position, and/or the trace thereof. Thus, the golfer can enjoy an unexpected happiness, thereby more frequently visiting a corresponding golf resort, and attracting golf customers to the golf resort. Furthermore, the event winning is automatically determined, which can attain an open and aboveboard event winning, and give trust of the event to the golfer.

The specific region or the specific event may be determined in various ways, and thus no further detailed descriptions thereof will be provided.

Another function of the management server 200 relating to the even will now be described.

An event display unit for displaying video is installed in the fairway region, the green region, or the driver shot region.

Figure 36:
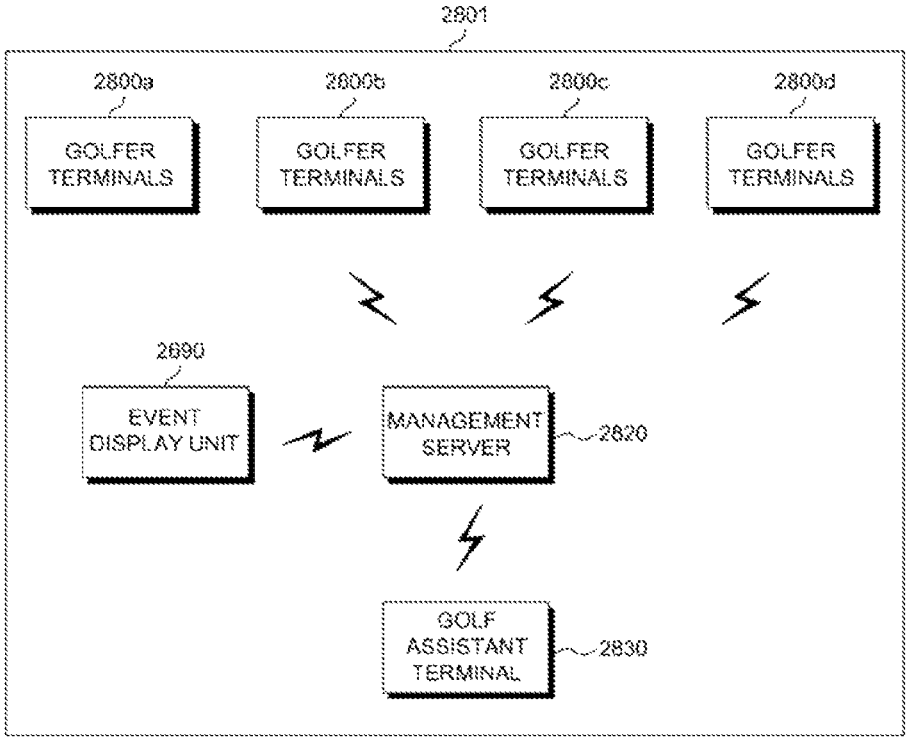
FIG. 36 is a block diagram of an intelligent real-time golf tournament management system according to another exemplary embodiment of the present invention.

FIG. 36 is a block diagram of an intelligent real-time golf tournament management system 2801 according to another exemplary embodiment of the present invention.

Displaying of video will now be described in detail with reference to FIG. 36.

Referring to FIG. 36, the intelligent real-time golf tournament management system 2801 of the present embodiment includes golfer terminals 2800*a*, 2800*b*, 2800*c*, and 2800*d*, a management server 2820, a golf assistant terminal 2830, and an event display unit 2890.

The golfer terminals 2800*a*, 2800*b*, 2800*c*, and 2800*d*, the management server 2820, and the golf assistant terminal 2830 may be respectively implemented to wholly or partially include the functions described above. The event display unit 2890 may display event winning or an event advertisement via video, text, or sound.

The management server 2820 has the following additional functions relating to the event display unit 2890.

The management server 2820 may have an event automatic acknowledgement function as described with reference to FIGS. 1 and 5 above. In this case, if the management server 2820 determines that an event wins, the event display unit 2890 may display event content, an event prize, and advertisement information regarding the event prize. To this end, the management server 2820 may have an image and sound processing function and the event display unit 2890 may have an image and sound processing function. If the management server 2820 determines that the event wins, the management server 2820 transmits previously stored event information and advertisement information to the event display unit 2890. The event display unit 2890 displays the received information.

Thus, this embodiment may be a good advertisement model for customer promotion from perspective of an advertiser and a golf management officer.

The management server 200 of the present invention may further have the following functions.

For example, the management server 200 may perform a function of maintaining and repairing a golf resort. The management server 200 may display a region where a shot is hit by using accumulated shot position information. For example, the management server 200 may mark the region where the shot is hit as "x" on a map of the golf resort. A region of the golf resort that specially needs to be maintained and repaired is a region where many shots are hit. The management server 200 may display the region where many shots are hit for the golf resort manager. In particular, to the management server 200 may determine the region where many shots are hit as a maintenance and repair region and display the maintenance and repair region. Although the management server 200 may directly perform the function of maintaining and repairing the golf resort as described above, the management server 200 can manage the golf resort in a different way. For example, an additional golf resort maintenance and repair management system can be constructed. This will be described in detail with reference to FIG. 39 later.

Figure 37:
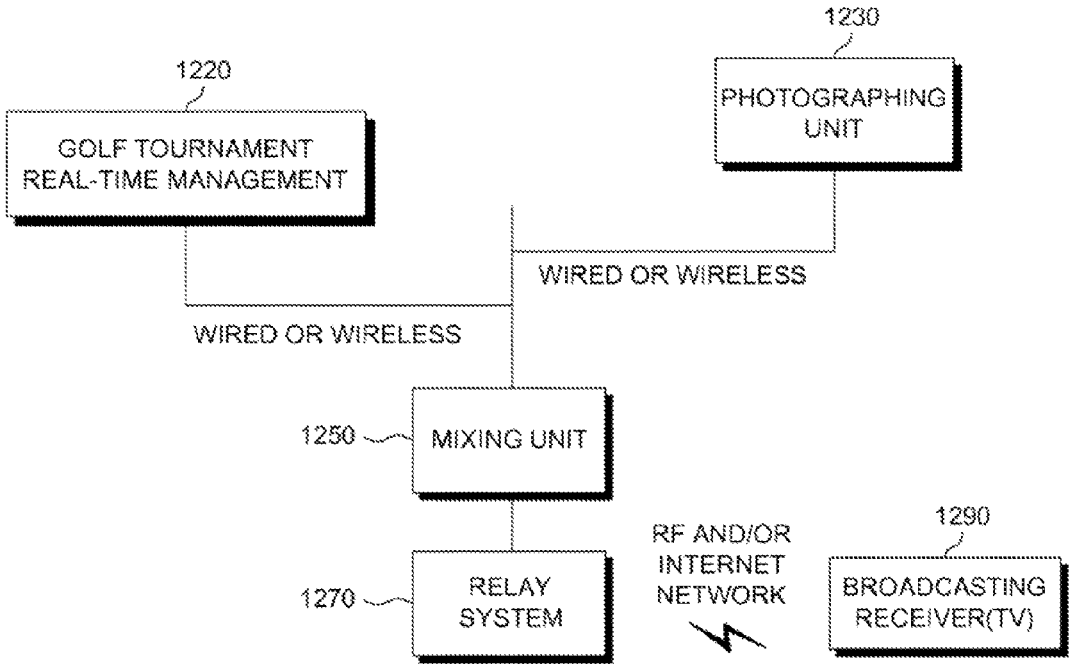
FIG. 37 is a block diagram of a golf tournament real-time relay system according to an exemplary embodiment of the present invention.

FIG. 37 is a block diagram of a golf tournament real-time relay system according to an exemplary embodiment of the present invention.

Referring to FIG. 37, the golf tournament real-time relay system includes a golf tournament real-time management system 1220, a photographing unit 1230, a mixing unit 1250, and a relay system 1270.

The golf tournament real-time management system 1220 collects golf tournament data in real time and provides the mixing unit 1250 with the golf tournament data. The golf tournament real-time management system 1220 may provide positions and/or number of shots of golfers in real time as described in the embodiments above. The golf tournament real-time management system 1220 provides the mixing unit 1250 with information including the positions of shots of golfers located on a map of the golf resort.

The photographing unit 1230 which photographs a golf tournament obtains an image of a golfer or the image and sound of the golfer and provides the mixing unit 1250 with the image of the golfer or the image and sound of the golfer.

The mixing unit 1250 receives the data from the golf tournament real-time management system 1220 and the photographing unit 1230 by wired or wireless in real time, mixes the received data, and transmits the mixed data to the relay system 1270. In this regard, the mixing unit 1250 may transmit the mixed data to the relay system 1270 by wired or wireless.

The relay system 1270 may transmit the data received from the mixing unit 1250 to a broadcasting receiver 1290 through RF. Differently, the relay system 1270 may transmit the mixed data to the broadcasting receiver 1290 through an Internet network. Differently, the relay system 1270 may transmit the mixed data to the broadcasting receiver 1290 through the RF and the Internet network sequentially.

The broadcasting receiver 1290 receives the mixed data from the relay system 1270 and displays the received data. The broadcasting receiver 1290 may display an actual screen of the golfer and a golf resort map screen on which a current position of the golfer or a position of a shot is displayed simultaneously or alternately according to a selection of a viewer.

In the present embodiment, although the mixing unit 1250 is separated from the relay system 1270, the mixing unit 1250 may be included in the relay system 1270.

According to an embodiment of the present invention, since the broadcasting receiver 1290 may display the actual screen of the golfer and the golf resort map screen on which the current position of the golfer or the position of the shot is displayed simultaneously or alternately, the mixing unit 1250 may mix and transmit the data transmitted from the golf tournament real-time management system 1220 and the photographing unit 1230. Differently, the broadcasting receiver 1290 may display the actual screen of the golfer and the golf resort map screen on which the current position of the golfer or the position of the shot is displayed simultaneously or alternately, through a functional module other than the mixing unit 1250.

Figure 38:
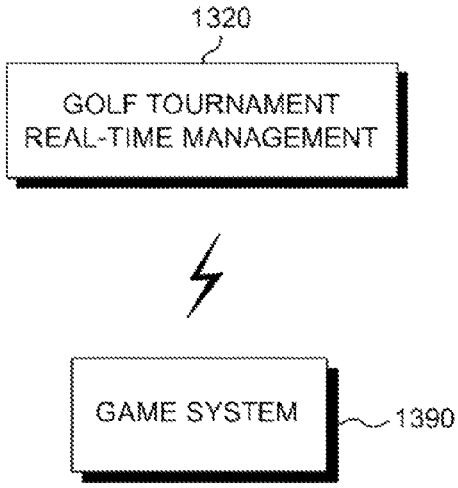
FIG. 38 is a block diagram of a golf game system according to an exemplary embodiment of the present invention.

FIG. 38 is a block diagram of a golf tournament system according to an exemplary embodiment of the present invention.

Referring to FIG. 38, the golf tournament system includes a golf tournament real-time management system 1320 and a tournament system 1390.

The golf tournament real-time management system 1320 provides collects golf tournament data in real time and provides the tournament system 1390 with the collected golf tournament data. The golf tournament real-time management system 1320 may provide the golf system 1390 with a name of a golf resort, a name of a golfer, and positions and/or number of shots of golfers for holes as described in the embodiments above.

The tournament system 1390 may receive the golf tournament data from the golf tournament real-time management system 1320 over a network or a local network.

The tournament system 1390 may provide, for example, an environment for screen golf. When two garners try to enjoy a screen golf tournament, the tournament system 1390 may provide one or two virtual image screen golf garners.

For example, there are two screen golf garners and one virtual golf gamer. If the two screen golf garners select a golf resort, the tournament system 1390 searches for data of a golfer (for example, Kyoungjoo CHOI) who actually plays golf in the selected golf resort. The data may be transmitted from the golf tournament real-time management system 1320 directly or over a network or via a storage medium as described above.

After the two screen golf gainers hit shots, for example, Kyoungjoo CHOI hits a shot on a screen. Positions and results of the shots are determined based on previously stored data.

That is, the two screen golf garners can enjoy a screen golf tournament with Kyoungjoo CHOI. This is possible through the tournament system 1390. The golf tournament data required by the tournament system 1390 may be received from the golf tournament real-time management system 1320.

Thus, if a user visits a screen golf place, other two or three users can enjoy the screen golf tournament with virtual persons together, which provides a joy. Also, if there are three actual screen golf garners and one virtual screen golf game, they can enjoy the screen golf tournament with famous golfers.

Figure 39:
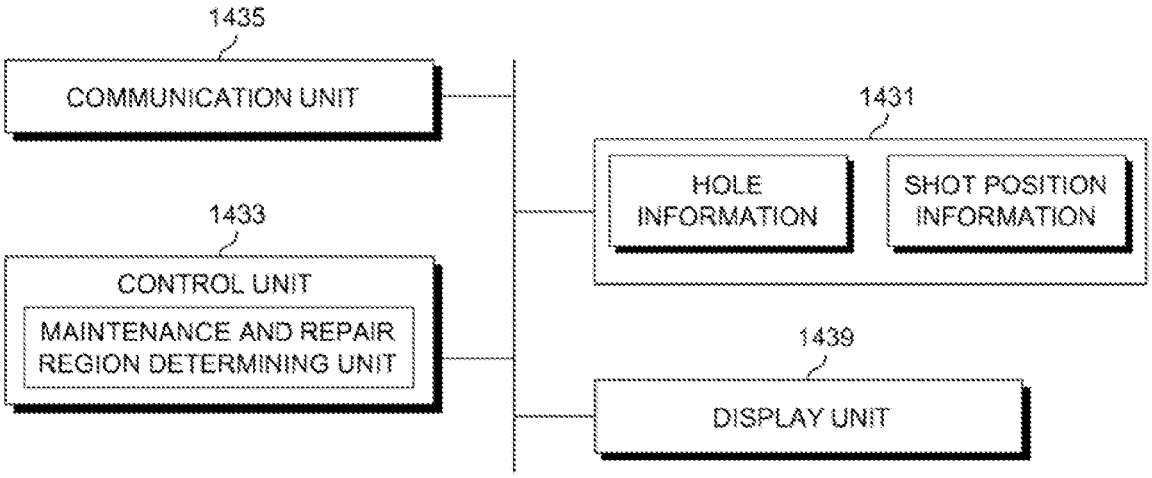
FIG. 39 is a block diagram of a golf resort maintenance and repair management system according to an exemplary embodiment of the present invention.

FIG. 39 is a block diagram of a golf resort maintenance and repair management system according to an exemplary embodiment of the present invention.

Referring to FIG. 39, the golf resort maintenance and repair management system includes a communication unit 1435, a control unit 1433, and a storage unit 1431.

The communication unit 1431 may support wired or wireless communication with the outside. Although hole information or shot position information stored in the storage unit 1431 may be data received through the communication unit 1435, the hole information or shot position information is not necessarily received through the communication unit 1435 and may be stored through a separate information transfer medium (a hard disk, etc.).

The storage unit 1431 stores the shot position information. Additionally, the storage unit 1431 may store the hole information.

The control unit 1433 may map the shot position information to holes (a golf resort) and display the mapped shot position information through a display unit 1439. Differently, the control unit 1433 may map the shot position information to the holes and transmit the mapped shot position information to a terminal (not shown) of a golf resort maintenance and repair manager.

The control unit 1433 may select a region where many shots are determined to be particularly hit based on the shot position information. For example, the control unit 1433 may determine a region where more shots are hit than the previously set number of shots as a maintenance and repair region.

In the present embodiment, although the control unit 1433 refers to the data stored in the storage unit 1431, the control unit 1433 may receive the hole information and the shot position information directly from a system defined as a golf tournament real-time management system in the present specification and determine the maintenance and repair region.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

The invention claimed is:

1. A golf score real-time automatic counting apparatus comprising: a storage unit for storing information regarding driver shot positions at holes; a communications unit for receiving position computation information for calculating a current position of a golfer; and a control unit for counting the number of driver shots if a condition to count a driver shot based on the information regarding the driver shot positions and information regarding the current position of the golfer is satisfied, wherein the storage unit further stores information regarding fairway positions in fairway regions of the holes and green region positions in green regions of the holes, and wherein the control unit counts fairway shots per hole by accumulating a fairway shot count, and acknowledging a par for each hole if a condition to count a fairway shot is satisfied based on the information regarding fairway positions and the information regarding the current position of the golfer, and wherein the control unit also counts putting shots per hole by accumulation if a condition to count a putting shot is satisfied based on the information regarding green region positions and the information regarding the current position of the golfer, and wherein the control unit selects the positions where the golfer does not move in the green region for a predetermined period of time, selects positions where a golf assistant does not move in the green region for the predetermined period of time, determines if there is the position where a putting shot estimated motion or a putting shot estimated sound occurs, and, if a position where the putting shot estimated motion or the putting shot estimated sound occurs corresponds to one of the positions where the golfer does not move and simultaneously corresponds to one of the positions where the golf assistant does not move, determines that the condition to count a putting shot is satisfied.

2. The golf score real-time automatic counting apparatus of claim 1, wherein the control unit determines that the condition to count a driver shot is satisfied, if the golfer enters into any one of the driver shot positions and leaves that driver shot position after a predetermined period of time.

3. The golf score real-time automatic counting apparatus of claim 1, wherein the control unit determines that the condition to count a driver shot is satisfied, if the golfer enters into any one of the driver shot positions, leaves that driver shot position after a predetermined period of time, and a driver shot estimated motion or a driver shot estimated sound occurs by which the golfer is estimated to hit a driver shot.

4. The golf score real-time automatic counting apparatus of claim 1, wherein the control unit determines that the condition to count a fairway shot is satisfied, if the golfer is located in the fairway region, stays at a region of the fairway region for a predetermined period of time, and leaves the region.

5. The golf score real-time automatic counting apparatus of claim 1, wherein the control unit determines that the condition to count a fairway shot is satisfied, if the golfer is located in the fairway region, stays at a region of the fairway region for a predetermined period of time, leaves the region, and a fairway shot estimated motion or a fairway shot estimated sound occurs by which the golfer is estimated to hit a fairway shot.

6. The golf score real-time automatic counting apparatus of claim 5, wherein the fairway shot estimated motion is a motion of a golfers' waist.

7. The golf score real-time automatic counting apparatus of claim 1, wherein the control unit determines if there is a position where a putting shot estimated motion or a putting shot estimated sound occurs, and, if the position where the putting shot estimated motion or the putting shot estimated sound occurs corresponds to one of the positions where the golfer does not move and simultaneously corresponds to one of the positions where the golf assistant does not move, determines that the condition to count a putting shot is satisfied.

8. A golf score real-time automatic counting apparatus comprising: a storage unit for storing information regarding driver shot positions at holes; a communications unit for receiving position computation information for calculating a current position of a golfer; and a control unit for counting the number of driver shots if a condition to count a driver shot based on the information regarding the driver shot positions and information regarding the current position of the golfer is satisfied, wherein the storage unit further stores information regarding fairway positions in fairway regions of the holes and green region positions in green regions of the holes, and wherein the control unit counts fairway shots per hole by accumulating a fairway shot count, and acknowledging a par for each hole if a condition to count a fairway shot is satisfied based on the information regarding fairway positions and the information regarding the current position of the golfer, and wherein the control unit also counts putting shots per hole by accumulation if a condition to count a putting shot is satisfied based on the information regarding green region positions and the information regarding the current position of the golfer, and wherein the control unit selects the positions where the golfer does not move in the green region for a predetermined period of time, selects the positions where a golf assistant does not move in the green region for the predetermined period of time, determines if there is a motion of assisting a putting shot by the golf assistant, and, if a position of the motion of assisting a putting shot by the golf assistant corresponds to one of the positions where the golfer does not move and simultaneously corresponds to one of the positions where the golf assistant does not move, determines that the condition to count a putting shot is satisfied.

* * * * *